US009278553B2

(12) United States Patent
Nakano et al.

(10) Patent No.: US 9,278,553 B2
(45) Date of Patent: Mar. 8, 2016

(54) RECORDING APPARATUS WITH MEDIUM RECEIVING TRAY HAVING RECESS FOR STORING FEEDING UNIT

(71) Applicant: SEIKO EPSON CORPORATION, Tokyo (JP)

(72) Inventors: Yosuke Nakano, Shiojiri (JP); Yoshiyuki Okazawa, Shiojiri (JP); Tomoko Shirai, Suwa (JP); Katsumi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 13/780,675

(22) Filed: Feb. 28, 2013

(65) Prior Publication Data

US 2013/0222504 A1 Aug. 29, 2013

(30) Foreign Application Priority Data

Feb. 28, 2012 (JP) ..... 2012-041932
Jul. 6, 2012 (JP) ..... 2012-152161

(51) Int. Cl.
*B41J 2/01* (2006.01)
*B41J 11/02* (2006.01)
*B41J 13/10* (2006.01)

(52) U.S. Cl.
CPC ..... *B41J 11/02* (2013.01); *B41J 13/106* (2013.01)

(58) Field of Classification Search
CPC ..... B41J 11/02; B41J 13/106
USPC ..... 347/104; 271/9.01, 264, 9.05, 4.01, 271/171; 400/624, 625; 399/393, 405
See application file for complete search history.

(56) References Cited

U.S. PATENT DOCUMENTS

| | | | | |
|---|---|---|---|---|
| 5,346,197 | A * | 9/1994 | Takano et al. | 271/9.05 |
| 5,746,528 | A * | 5/1998 | Mayer et al. | 400/625 |
| 5,897,110 | A * | 4/1999 | Fujiwara | 271/4.01 |
| 7,251,451 | B2 * | 7/2007 | Takagi et al. | 399/405 |
| 7,322,763 | B2 * | 1/2008 | Yang | 400/624 |
| 8,272,637 | B2 * | 9/2012 | Asada et al. | 271/171 |
| 2005/0196212 | A1 * | 9/2005 | Takemoto et al. | 399/393 |
| 2007/0075476 | A1 * | 4/2007 | Shiohara | 271/9.01 |
| 2008/0237977 | A1 * | 10/2008 | Izuchi et al. | 271/264 |
| 2012/0081488 | A1 * | 4/2012 | Asada et al. | 347/104 |

FOREIGN PATENT DOCUMENTS

| | | |
|---|---|---|
| JP | 3710386 | 10/2005 |
| JP | 2006-001705 | 1/2006 |

* cited by examiner

*Primary Examiner* — Julian Huffman
*Assistant Examiner* — Carlos A Martinez
(74) *Attorney, Agent, or Firm* — Workman Nydegger

(57) ABSTRACT

A printer includes a configuration, in which a paper is delivered between a recording head which is positioned upwards from a tray and a support member, and the recording is performed, and then the paper is discharged towards a discharged-paper receiving tray. The discharged-paper receiving tray is configured such that a relief section is formed to avoid an arrangement region of an oscillation member configuring a feeding unit upstream thereof, and the oscillation member is able to oscillate inside the relief section.

13 Claims, 19 Drawing Sheets

RECORDING APPARATUS WITH MEDIUM RECEIVING TRAY HAVING RECESS FOR STORING FEEDING UNIT

BACKGROUND

1. Technical Field

The present invention relates to a recording apparatus including a medium receiving tray which receives a medium to be discharged by performing a recording.

2. Related Art

A printer as an example of a recording apparatus is configured such that a discharged-paper receiving tray (also, referred to as a discharged-paper stacker and, hereinafter, referred to as "a tray") is provided which receives a medium (for example, a recording paper) discharged by performing a recording and the recording papers on which the recording is performed are stacked sequentially in the tray.

A tray may be configured in a multi-stage type so that occupation space thereof is small when not in use and a surface receiving the recording medium may be widely developed when in use (for example, see, JP-A-2006-001705).

However, in a case where a configuration may take a storage state in which the tray is stored inside a recording apparatus and an used state in which the tray is used by drawing out from the recording apparatus, since the tray occupies space inside the apparatus in the storage state, it is easy to cause an increase in size of the apparatus.

SUMMARY

An advantage of some aspects of the invention is to provide a recording apparatus in which an increase in the size of the apparatus is suppressed by saving storage space of the tray inside the apparatus.

According to a first aspect of the invention there is provided a recording apparatus including: a medium storage section storing a medium; a feeding unit which delivers the medium from the medium storage section; a recording unit which performs a recording on the medium delivered from the medium storage section; a discharging unit which discharges a recorded medium on which the recording is performed by the recording unit; and a medium receiving tray in which a relief section is formed to avoid the feeding unit and which receives the medium discharged by the discharging unit.

In this aspect, since the medium receiving tray which receives the medium discharged by the discharging unit has the relief section for avoiding the feeding unit, the feeding unit and the medium receiving tray are not necessary to be superimposed to each other in the height direction of the apparatus and both can be overlapped in the height direction and then an increase in the dimensions of the height direction of the apparatus can be suppressed.

The medium receiving tray may be displaced between a storage position which is stored inside the body of the recording apparatus and a protrusion position which is protruded from the body of the recording apparatus and receives the medium, by sliding in a medium discharging direction, and the feeding unit is positioned inside the relief section when the medium receiving tray is in the storage position.

In this case, since the medium receiving tray takes a storage state in which the medium receiving tray is stored inside the body of the recording apparatus and a protrusion state in which the medium receiving tray is protruded from the body of the recording apparatus and receives the medium, by sliding in the medium discharging direction, installation space of the recording apparatus in the storage state can be saved and the medium receiving surface receiving the medium in the used state can be largely secured.

The feeding unit may include a feeding roller which is provided to be displaceable in an advancing and retracting direction with respect to a bottom surface of the medium storage section; and a roller support member which supports the feeding roller and is provided to be oscillated so that the feeding roller is capable of being displaced; and the roller support member may be positioned inside the relief section when the medium receiving tray is positioned in the storage position.

The medium receiving tray is configured such that an entire region of a medium receiving surface which receives the medium may be formed of one member and the relief section may be formed in one member.

In this case, since the medium receiving tray is configured such that the entire region of the medium receiving surface which receives the medium is formed of one member and the relief section is formed in one member, improvement of overall stiffness of the medium receiving tray is achieved and a reduction of the cost is achieved by simplifying the structure. Then, the dimensions of the medium receiving tray can be largely secured in the storage state by forming the relief section. Even though the medium receiving tray is configured of one member, the medium receiving surface can be largely secured.

The medium receiving tray may include a ridge section on which both end portions of the medium ride downstream the medium receiving surface which receives the medium in a direction intersecting the medium discharging direction, and the relief section may be provided at the center portion upstream the medium receiving surface in a direction intersecting the medium discharging direction.

In this case, since the medium receiving tray includes the ridge section on which both end portions of the medium ride downstream the medium receiving surface which receives the medium and the relief section is provided at the center portion upstream the medium receiving surface, curls can be easily formed on the medium discharged on the medium receiving tray, the front end of the medium which is discharged can be prevented from hanging and eventually falling by being protruded from the front end of the medium receiving tray.

A rack section configuring a rack and pinion mechanism may be formed along the medium discharging direction in the end portion of the medium receiving tray in a direction intersecting the medium discharging direction, and the rack section may have a configuration in which the medium receiving tray is operated to be slidable when receiving power.

The medium receiving tray may be positioned between the medium storage section and the recording unit in a height direction of the apparatus, and the upstream end portion of the medium receiving tray may be in a position in which the feeding path of the medium which is delivered from the medium storage section and directed towards the recording unit is closed when the medium receiving tray is in the storage position.

In this case, since the upstream end portion of the medium receiving tray is in the position in which the feeding path of the medium which is delivered from the medium receiving surface and directed towards the recording unit is closed, the medium receiving surface receiving the medium in the medium receiving tray can be largely secured.

The relief section may be configured of a notch section which is formed from the end portion of the medium receiving tray upstream the recording medium in the medium discharging direction towards downstream in the medium discharging direction, and the notch section may be formed such that a width thereof is gradually narrowed from the both side sections of the width direction orthogonal to the medium discharging direction towards downstream in the medium discharging direction.

In this case, since the width of the notch section is gradually narrowed from the both side sections to downstream in the medium discharging direction, it is possible to suppress that the recording medium discharged on the discharge tray is caught on the notch section. Accordingly, even though the notch section is provided on the discharge tray for discharging the recording medium, the recording medium can be smoothly discharged on the discharge tray.

The notch section may have a shape in which the both end portions in the width direction orthogonal to the medium discharging direction and a downstream end in the medium discharging direction configured of one point are connected to each other.

In this case, since the width of the notch section is gradually narrowed towards downstream in the medium discharging direction between the both side sections in the medium discharging direction and the downstream end configured of one point, it is possible to effectively suppress that the medium discharged on the discharge tray is caught on the downstream end of the notch section.

The downstream end of the notch section may be positioned at the center in the width direction.

In this case, it is possible to stably suppress that the recording medium discharged on the discharge tray is caught on the downstream end of the notch section.

The notch section may have a line symmetrical shape with a symmetrical axis of the straight line which passes through the downstream end thereof and extends along the medium discharging direction.

In this case, it is possible to suppress in good balance that the recording medium discharged on the discharge tray is caught on the downstream end of the notch section.

The width of the notch section may be set to be narrower than the width of the recording medium having the minimum width which is assumed of being printed in the recording unit.

In this case, it is possible to suppress that the recording medium discharged on the discharge tray falls from the notch section.

A distance from the both side portions of the notch section to the downstream end in the medium discharging direction may be set to be equal to or greater than half of the width of the notch section.

In this case, it is possible to further effectively suppress that the recording medium discharged on the discharge tray is caught on the downstream end of the notch section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, based on the drawings. The invention is not limited to the following description, and various modifications may be possible within a range of the invention described in the claims. In addition, assuming that the modifications are also intended to be included in the range of the invention, hereinafter, an embodiment of the invention will be described.

First Embodiment

Figure 1:
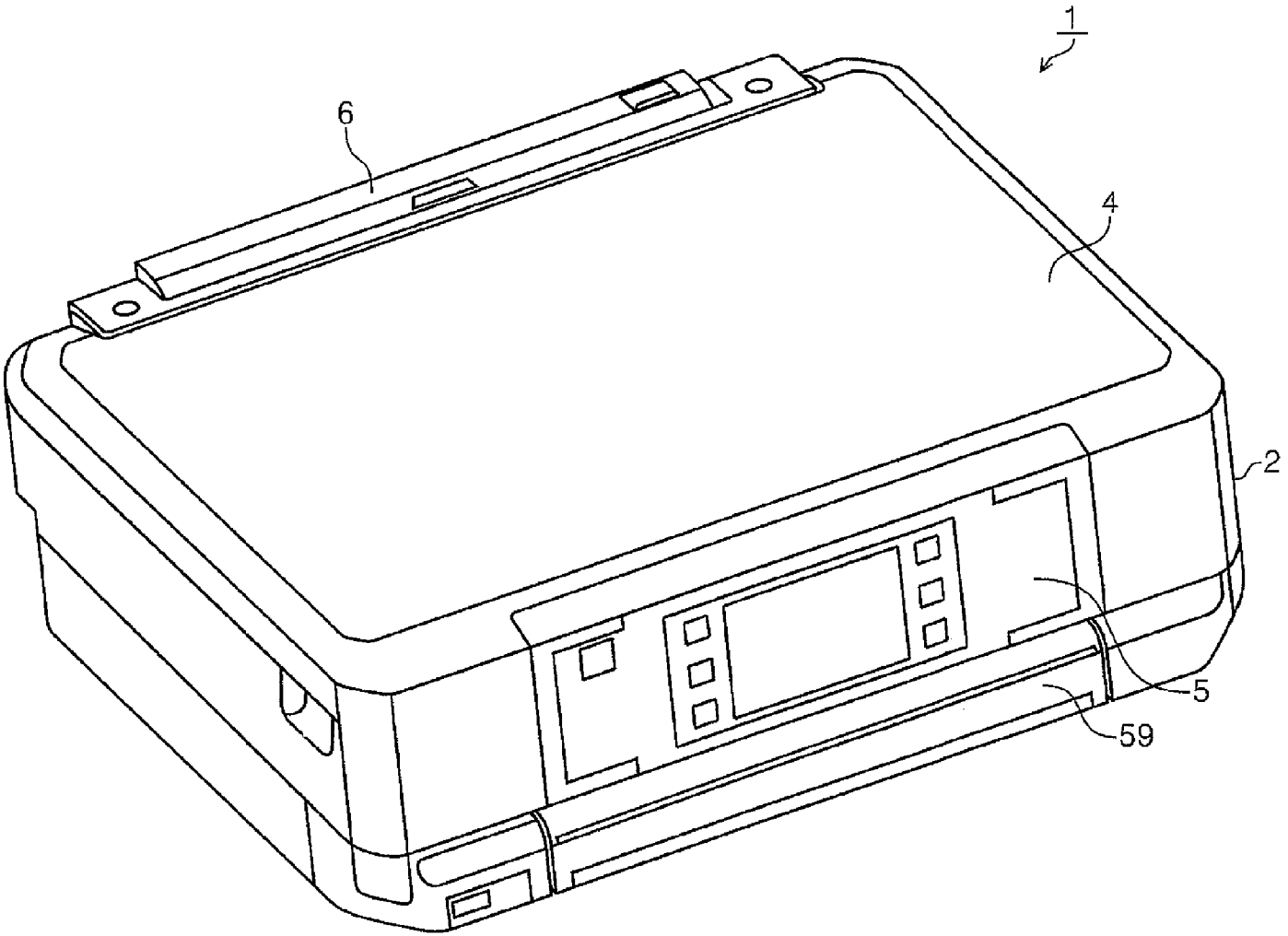
FIG. 1 is an external perspective view of a printer according to the invention.
Figure 2:
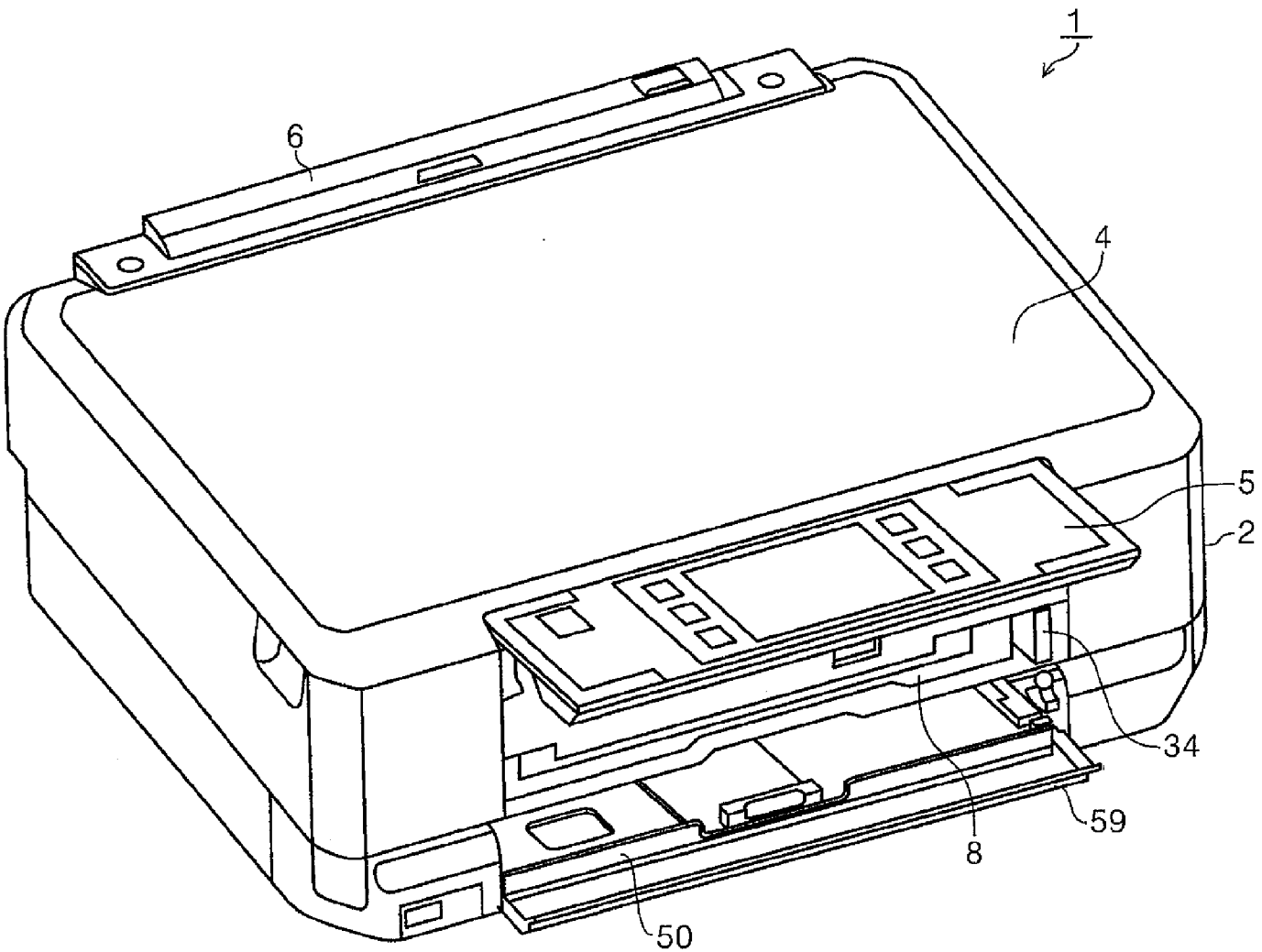
FIG. 2 is an external perspective view of a printer according to the invention.
Figure 3:
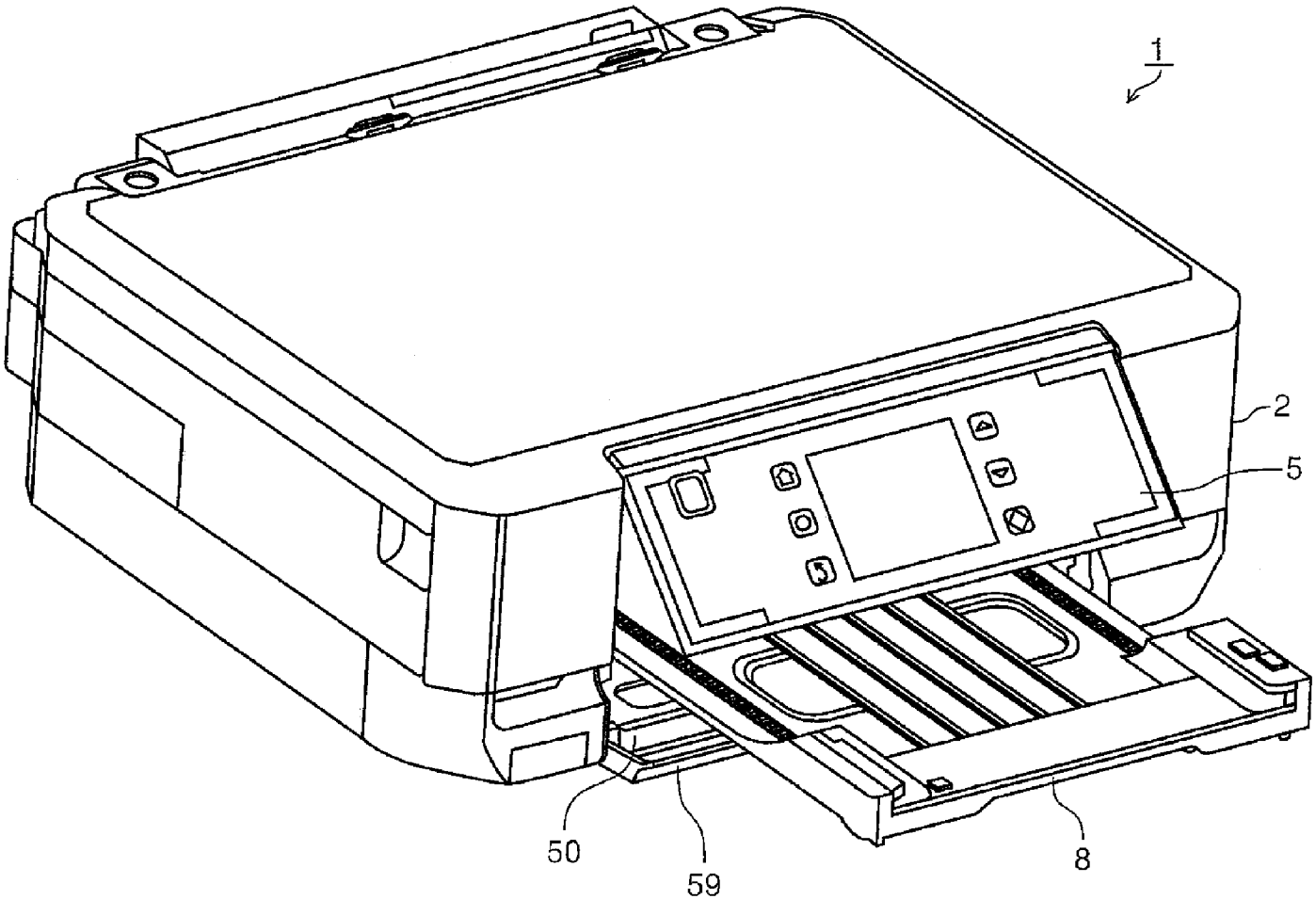
FIG. 3 is an external perspective view of a printer according to the invention.
Figure 4:
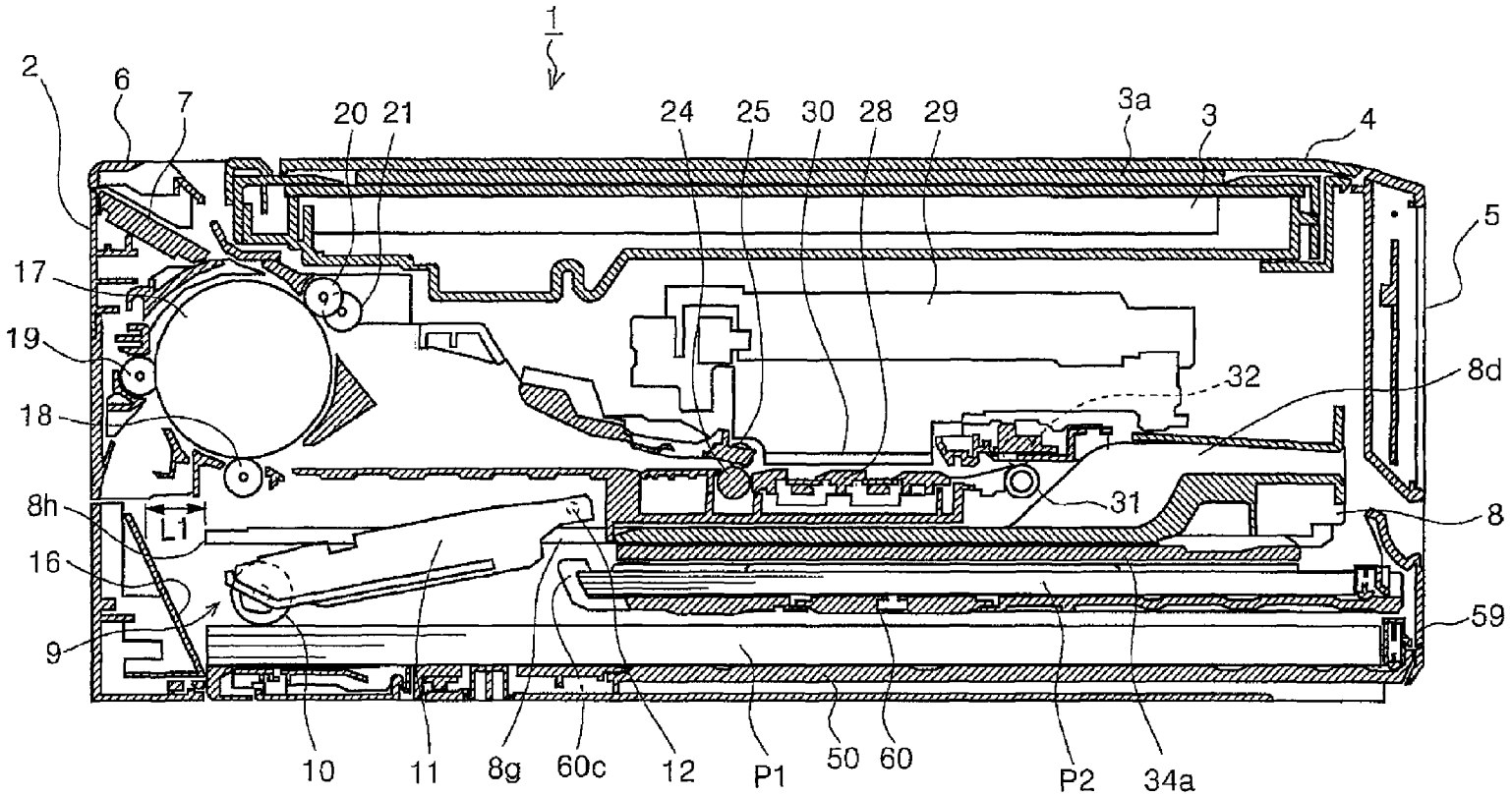
FIG. 4 is a side cross-sectional view illustrating a paper feeding path of a printer according to the invention.
Figure 5:
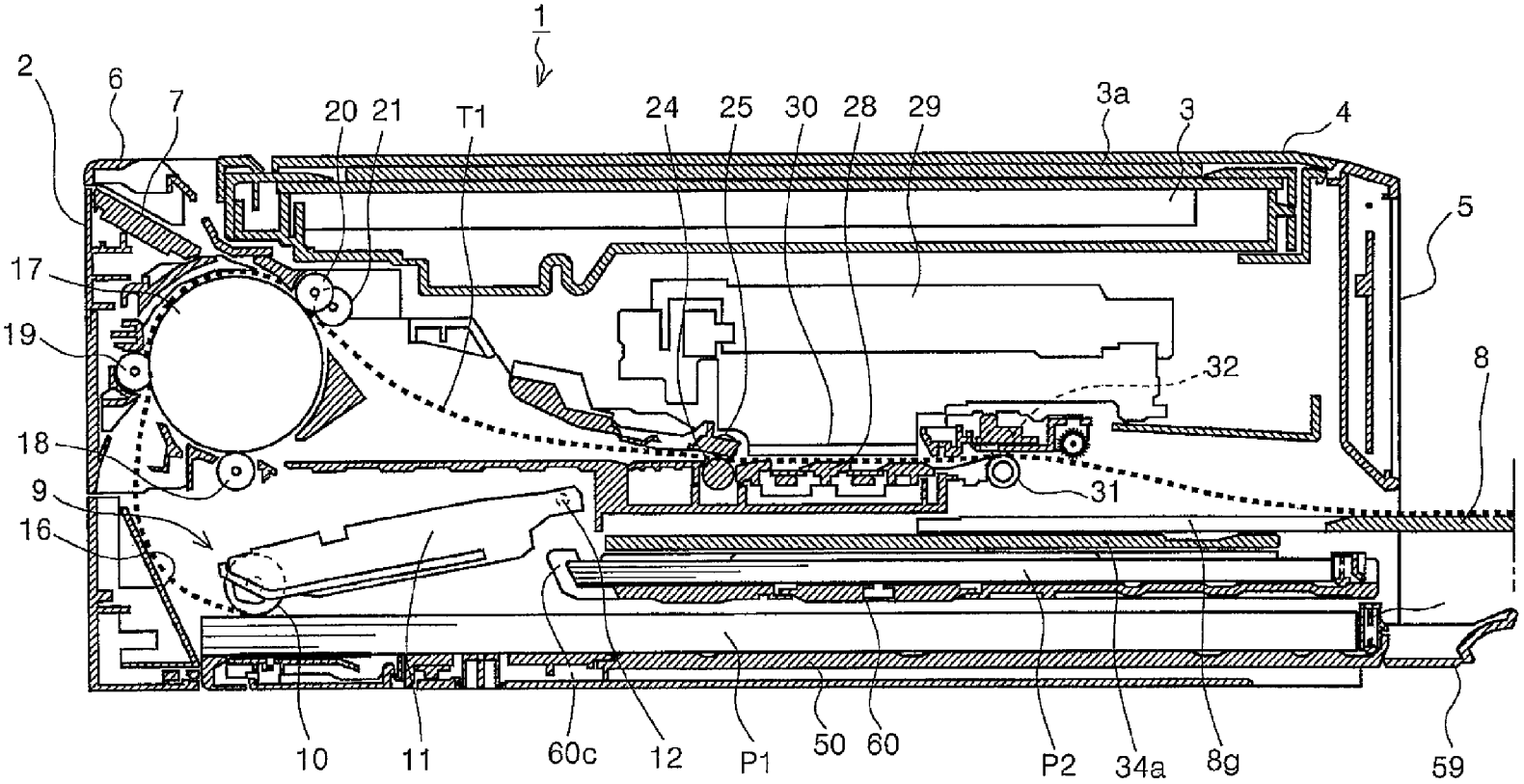
FIG. 5 is a side cross-sectional view illustrating a paper feeding path of a printer according to the invention.
Figure 6:
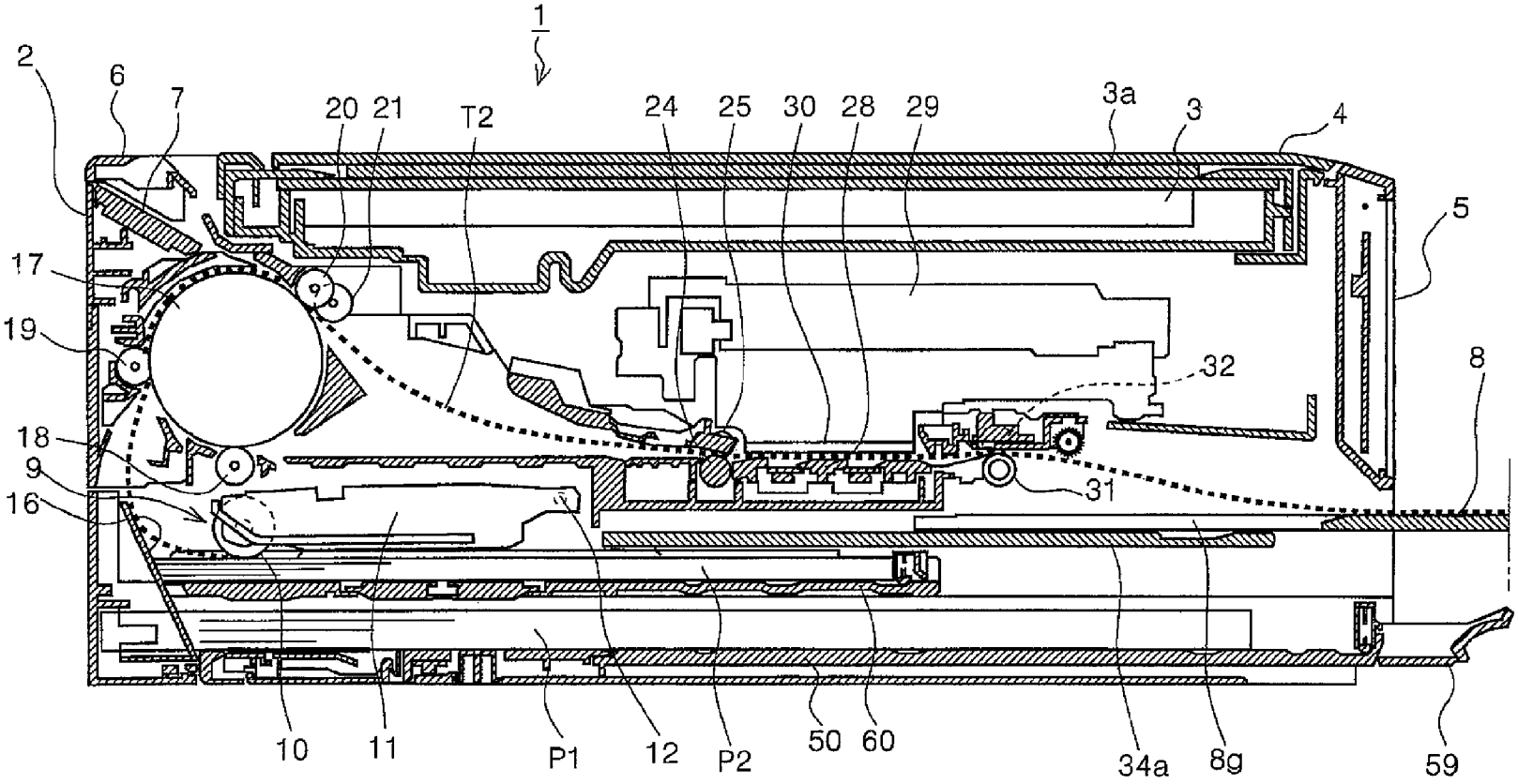
FIG. 6 is a side cross-sectional view illustrating a paper feeding path of a printer according to the invention.
Figure 7:
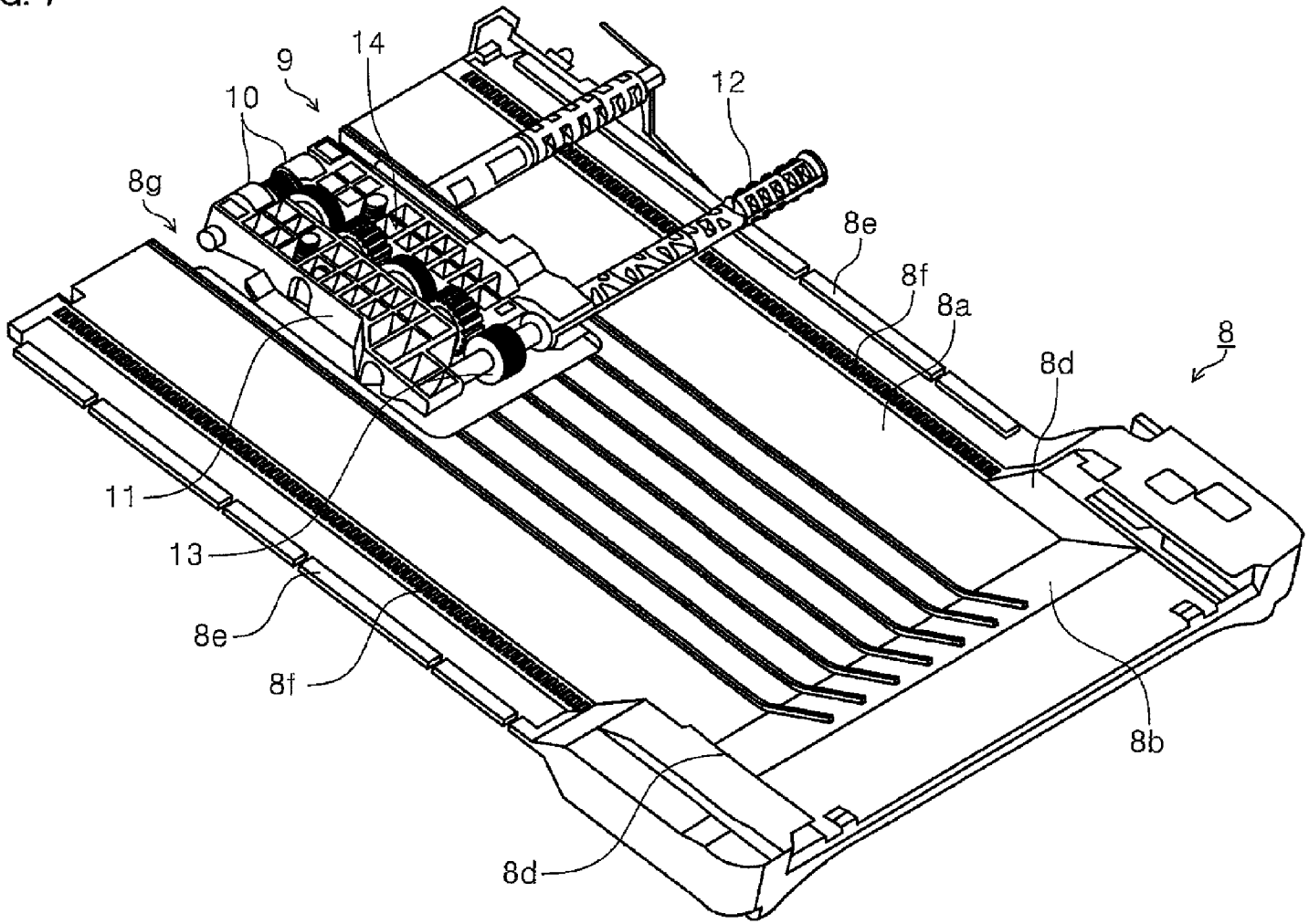
FIG. 7 is a perspective view illustrating a positional relationship between a feeding unit and a discharged-paper receiving tray.
Figure 8:
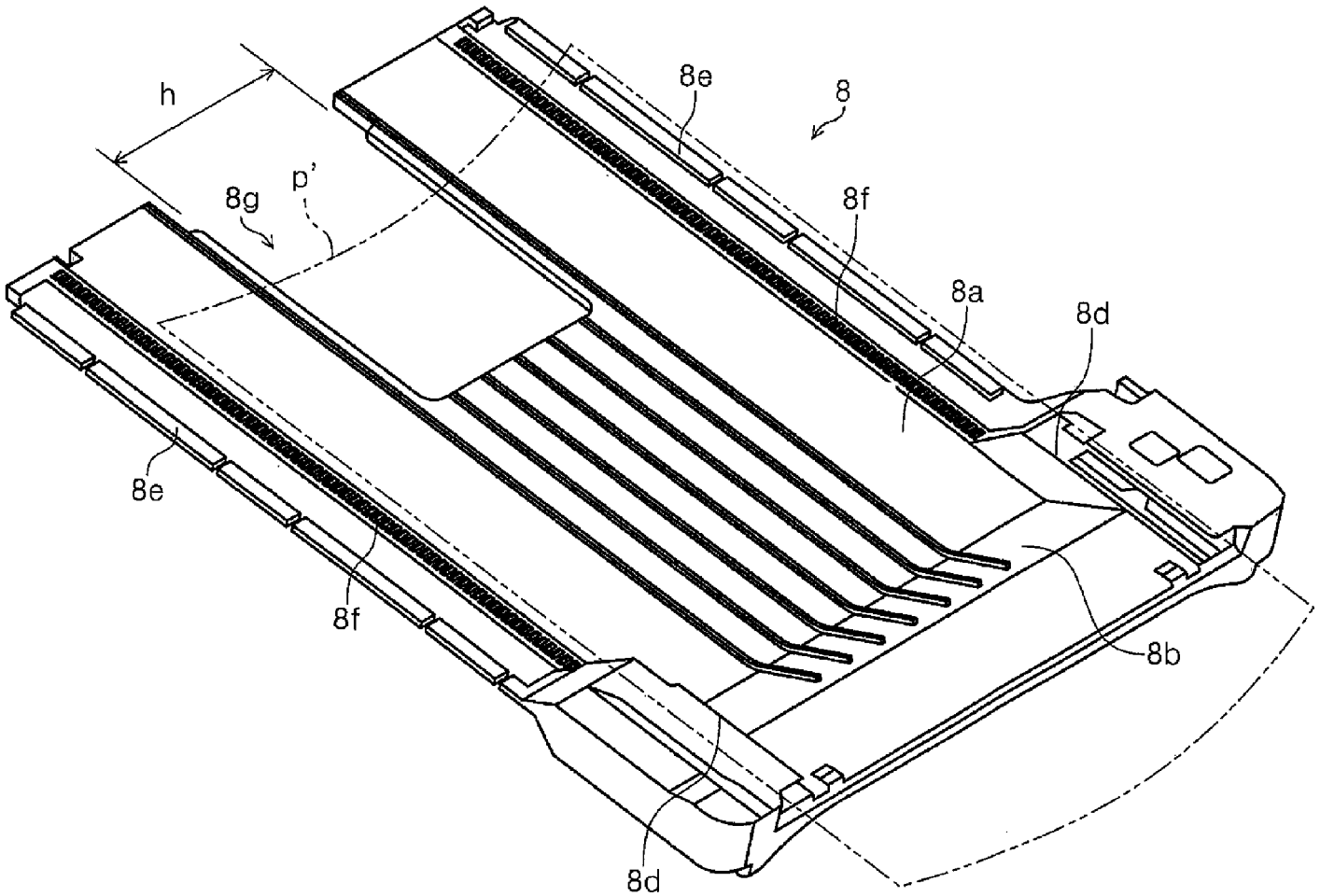
FIG. 8 is a perspective view of a discharged-paper receiving tray.
Figure 9:
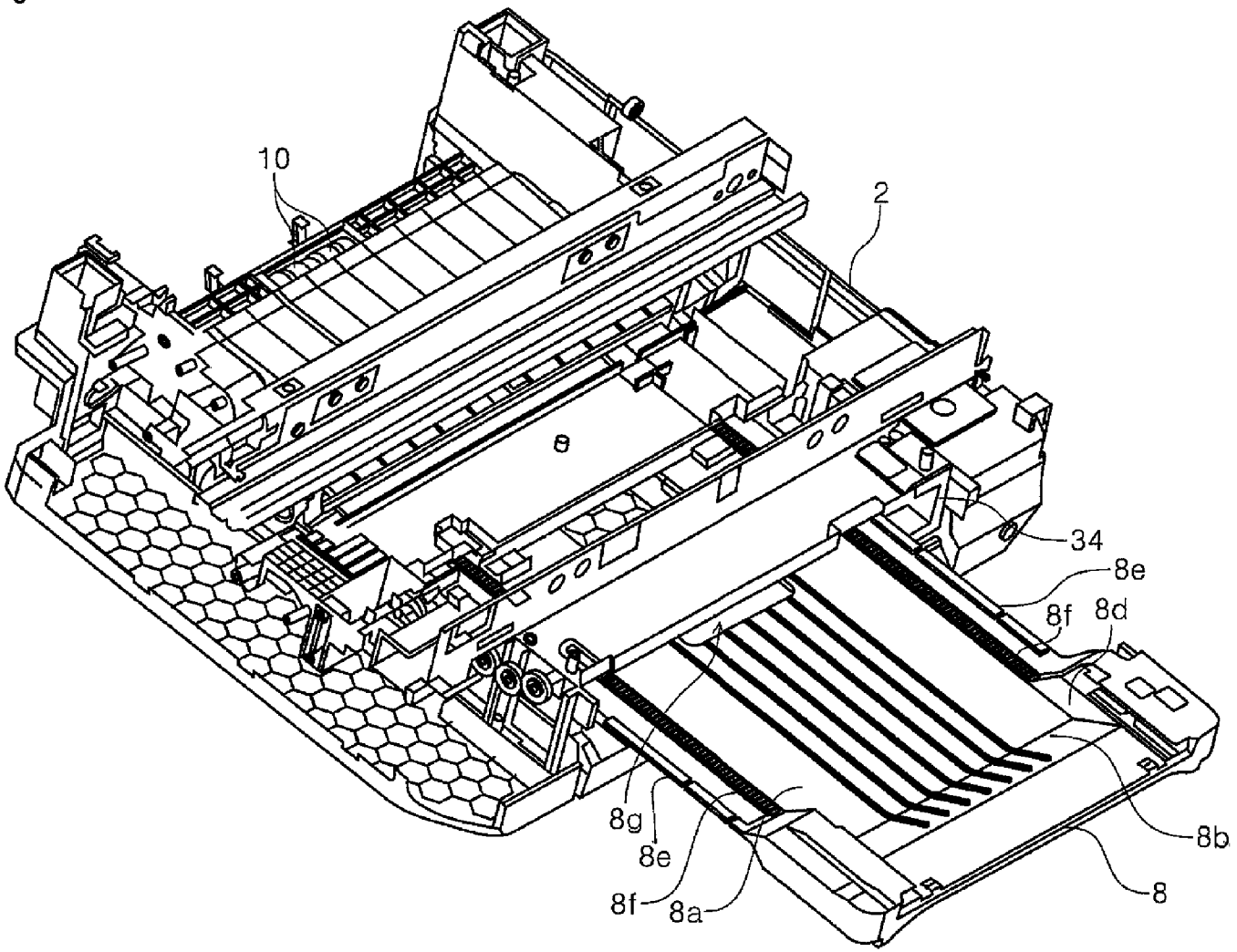
FIG. 9 is a perspective view illustrating a state where a discharged-paper receiving tray protrudes from an apparatus body.

FIGS. 1 to 3 are external perspective views of an ink jet type printer (hereinafter, referred to as "a printer") 1 of an embodiment of "a recording apparatus" according to the invention, FIGS. 4 to 6 are side cross-sectional views illustrating a paper feeding path of the printer 1, FIG. 7 is a perspective view illustrating a positional relationship between a feeding unit 9 and a discharged-paper receiving tray 8, FIG. 8 is a perspective view of the discharged-paper receiving tray 8 and FIG. 9 is a perspective view illustrating a state where the discharged-paper receiving tray 8 protrudes from an apparatus body 2.

1. Entire Configuration of Printer

Hereinafter, the entire configuration of the printer 1 will be described with reference to FIGS. 1 to 6. The printer 1 includes a scanner unit 3 (FIGS. 4 to 6) on an upper portion of the apparatus body (a recording section) 2 which performs an ink jet recording on a recording paper as an example of a medium, in other words, is configured as a multi-function machine including an ink jet recording function by adding a scanner function.

The scanner unit 3 is rotatably provided in the apparatus body 2 and may be a closed state (FIG. 1) and an open state (not illustrated) by rotation.

A cover 4 on the upper portion of the scanner unit 3 is an openable cover and a platen 3*a* (FIGS. 4 to 6) of the scanner unit 3 is set to appear by opening the cover 4.

A reference numeral 5 in the front of the apparatus is an operation panel including a power supply button or operation buttons which performs various print settings and recording performance, and a display section which performs a preview display of a print setting content, a print image, or the like. The operation panel 5 is configured to be able to tilt. FIG. 1 illustrates a full closed state, FIG. 2 illustrates a full open state and FIG. 3 illustrates a half-open state, respectively. The operation panel 5 illustrated in FIGS. 1 to 3 may be adjusted to angles at which a user easily operates the operation panel 5. In addition, the open angle of the operation panel 5 is held by an angle holding unit (not illustrated) and the angle is held for the button operation even when receiving an external force in the closing direction.

A reference numeral 59 in the front of the apparatus is an openable cover provided in a lower side tray 50. FIG. 1 illustrates a closed state of the cover 59, FIGS. 2 and 3 illustrate an open state of the cover 59, respectively. Then, the lower side tray 50, an upper side tray 60 and the discharged-paper receiving tray 8 may be exposed by opening the cover 59, and a detaching work of the lower side tray 50 or the upper side tray 60, or a sliding operation of the discharged-paper receiving tray 8 may be performed.

The discharged-paper receiving tray 8 is provided so as to be displaceable by sliding between a storage position (FIGS. 1, 2 and 4) stored in the apparatus body 2 and a protrusion position (FIGS. 3, 5 and 6) protruded to the front side of the apparatus body 2 by a motor (not illustrated). The recording paper which is discharged by performing the recording may be received in the discharged-paper receiving tray 8 by taking the protrusion position protruded to the front side of the apparatus body 2.

The lower side tray 50 and the upper side tray 60 provided on the upper portion thereof are capable of storing a plurality of recording papers, and are detachably provided in the apparatus body 2.

Subsequently, a reference numeral 6 in the rear upper portion of the apparatus body 2 is an openable manual cover and paper feeding of the recording papers is performed manually using a manual tray 7 (FIGS. 4 to 6) by opening the manual cover 6.

Subsequently, the paper feeding path of the printer 1 is described mainly with reference to FIGS. 4 to 6. The printer 1 according to the embodiment includes the lower side tray 50 and the upper side tray 60 at the bottom of the apparatus, and the recording paper is fed one sheet at a time from the lower side tray 50 or the upper side tray 60.

The upper side tray 60 is provided so as to be displaceable by sliding between a feedable position (FIG. 6) and a retracted position (FIGS. 4 and 5), and is configured to be displaced between the feedable position (FIG. 6) and the retracted position (FIGS. 4 and 5) by receiving power from a motor (not illustrated).

In addition, in the FIGS. 4 to 6, a paper stored in the lower side tray 50 is illustrated in a reference numeral P1 and a paper stored in the upper side tray 60 is illustrated in a reference numeral P2, respectively (hereinafter, if there is no particular need to distinguish, referred to as "a paper P"). In addition, a passage trace of the paper P1 fed from the lower side tray 50 is illustrated in a dashed line T1 and a passage trace of the paper P2 fed from the upper side tray 60 is illustrated in a dashed line T2, respectively.

A feeding roller (also referred to as a pick-up roller) 10 which is driven to rotate by a motor (not illustrated) is provided on an oscillation member 11 as "a roller support member" oscillating around a rotation shaft 12. When the upper side tray 60 slides to the most front side (the right side in FIGS. 4 to 6: a drawing-out direction side of the upper side tray 60) of the apparatus, in other words, when the upper side tray 60 is in the retracted position (the state illustrated in FIGS. 4 and 5), the uppermost paper P1 is fed from the lower side tray 50 by rotating the feeding roller 10 in a state where the feeding roller 10 comes into contact with the uppermost paper of the papers P1 stored in the lower side tray 50.

In addition, when the upper side tray 60 is in a butted position by sliding to the most rear side (the left side in FIGS. 4 to 6: a mounting direction side of the upper side tray 60 and a paper delivery direction side) of the apparatus, in other words, in the feedable position of the upper side tray 60 (the state illustrated in FIG. 6), the uppermost paper P2 is fed from the upper side tray 60 by rotating the feeding roller 10 in a state where the feeding roller 10 comes into contact with the uppermost paper of the papers P2 stored in the lower side tray 60.

In addition, in the embodiment, as illustrated in FIG. 8, the rotation shaft 12 configures an oscillation shaft of the oscillation member 11 and is rotated by receiving power from a motor (not illustrated) and then transmits the power from a transmission gear 13 provided on the rotation shaft 12 to the feeding roller 10 via a gear race train 14 as illustrated in FIG. 7. In addition, in the embodiment, the oscillation member 11 and the feeding roller 10 configures the feeding unit 9 (FIG. 7) feeding the paper P.

Subsequently, a separation slope 16 is provided in a position facing the front ends of the lower side tray 50 and the upper side tray 60 in the apparatus body 2. In a state where the lower side tray 50 is mounted, a stopper (not illustrated) provided in the front end of the lower side tray 50 enters to a back side more than the separation slope 16 (the left side in FIGS. 4 to 6) and the front end of the paper stored in the lower side tray 50 is capable of abutting the separation slope 16.

In addition, in the upper side tray 60, a stopper 60*c* provided in the front end of the upper side tray 60 enters to the back side more than the separation slope 16 and the front end of the paper stored in the upper side tray 60 is capable of abutting the separation slope 16 in a state where the upper side tray 60 is positioned in a feedable position (the butted position: FIG. 6).

Then, the paper P delivered from the lower side tray 50 or the upper side tray 60 advances downstream while the front end thereof comes into contact with the separation slope 16 and then the uppermost paper P to be fed separates from hereafter papers P.

An intermediate roller 17 which is driven to rotate by a motor (not illustrated) is provided ahead of the separation unit 14. The paper P is curved to be converted and is towards the front side of the apparatus by the intermediate roller 17. In addition, reference numerals 19, 20 and 21 are driven rollers which are rotatably driven and at least the paper P is nipped by the driven roller 19 and the intermediate roller 17. In addition, the paper P is nipped by the driven roller 20 and the intermediate roller 17 and then is transported downstream.

A transportation driving roller 24 which is driven to rotate by a motor (not illustrated) and a transportation driven roller 25 coming into contact with the transportation driving roller 24 are provided ahead of the intermediate roller 17, and the paper P is transported below the recording head 30.

Subsequently, the recording head 30 ejecting the ink is provided on the bottom portion of the carriage 29 and the carriage 29 is driven to reciprocate in a main scanning direction (front and rear direction of a paper in FIGS. 4 to 6) by a motor (not illustrated).

A support member 28 is provided in a position facing the recording head 30 and an interval between the paper P and the recording head 30 is defined by the support member 28. A discharging unit including a discharge driving roller 31 which is driven to rotate by a motor (not illustrated) and a discharge driven roller 32 which is driven to rotate coming into contact with the discharge driving roller 31 is provided downstream the support member 28. The paper P which is recorded by the recording head 30 is discharged towards the discharged-paper receiving tray 8 described above by the rollers.

2. Details of Discharged-Paper Receiving Tray 8

The entire configuration of the printer 1 is described above and hereinafter, the discharged-paper receiving tray 8 as a medium receiving tray will be described.

In the embodiment, the discharged-paper receiving tray 8 is configured such that an entire paper receiving surface 8*a* (medium receiving surface) receiving the paper is formed of one member, in other words, the discharged-paper receiving tray 8 is not configured of a multi-stage type (a pull-out type) but configured of a one-stage type. More particularly, in the embodiment, the entire discharged-paper receiving tray 8 is integrally formed with a resin material. Accordingly, improvement of overall stiffness as the discharged-paper receiving tray is achieved and a reduction of the cost is achieved by simplifying the structure.

An end portion (an end portion in a direction (a width direction of the paper) intersecting the paper discharging direction) 8*e* of discharged-paper receiving tray 8 is slidably supported to a frame 34 (FIG. 9) configuring a base body of the apparatus body 2. Rack sections 8*f* are formed in both ends (both ends in a direction intersecting the paper discharging direction) of the discharged-paper receiving tray 8 along the paper discharging direction. The rack section 8*f* is a rack configuring a rack and pinion mechanism and engages a pinion gear (not illustrated). The discharged-paper receiving tray 8 is operated to slide by the rotation of the pinion gear with power from a motor (not illustrated). In addition, in the embodiment, the rack sections 8*f* are formed in both sides, however, they may be formed in any one of both sides.

A relief section 8*g* (a notch section) avoiding the feeding unit 9 is formed upstream (left side in FIGS. 4 to 6 and left upper side in FIGS. 7 and 8) the discharged-paper receiving tray 8 in the paper discharging direction. The relief section 8*g* is configured such that the width (the width in the paper width direction) h thereof is set to be slightly greater than the width of the oscillation member 11, in other words, is set such that the oscillation member 11 may be oscillated inside the relief section 8*g*. In addition, in the embodiment, in order to set a feeding reference position in the paper width direction to the center of the paper, the relief section 8*g* is formed substantially at the center in the paper width direction.

The relief section 8*g* has operational advantage as described below. In other words, the discharged-paper receiving tray 8 may be stored inside the apparatus body 2, however, when the feeding unit 9 and the discharged-paper receiving tray 8 are provided to be superimposed in a state where the discharged-paper receiving tray 8 is stored inside the apparatus body, size of the apparatus is likely to be increased (specifically, increase in dimensions in the height direction).

However, as described above, since the discharged-paper receiving tray 8 has the relief section 8*g* avoiding the feeding unit 9, it is not necessary to overlap the feeding unit 9 and the discharged-paper receiving tray 8 in the height direction of the apparatus and both can be superimposed in the height direction, and the increase in the dimensions in the height direction of the apparatus can be suppressed.

Next, ridge sections 8*d* on which both ends of the paper rise are formed downstream the paper receiving surface 8*a* in the discharged-paper receiving tray 8. Both ends (the both ends in the direction (the paper width direction) intersecting the paper discharging direction) of the paper rise on the ridge sections 8*d* so that a curl is formed in the paper. The paper illustrated in a symbol P' and in an imaginary line in FIG. 8 indicates the state where such a curl is formed. Both ends downstream the paper receiving surface 8*a* rise on the ridge sections 8*d* and further, the center portion upstream the paper receiving surface 8*a* slightly enters into the relief section 8*g* so that the curl is formed in the paper.

Accordingly, the front end of the paper can be prevented from hanging and eventually falling by being protruded from the paper receiving surface 8*a*. In addition, as illustrated in FIG. 8, it is preferable that the relief section 8*g* may be formed in the center portion in the paper width direction in order to form the curl in the paper. However, even though the relief section 8*g* is formed at the end portion in the paper width direction, the curl can be promoted in the paper if the ridge sections 8*d* are formed at both ends downstream the paper receiving surface 8*a*.

In addition, the discharged-paper receiving tray 8 is configured such that a slope 8*b* is formed downstream the paper receiving surface 8*a* which receives the paper, in other words, the supported paper is inclined upwards. Accordingly, the discharged paper is unlikely to fall down.

In addition, in the embodiment, when the discharged-paper receiving tray 8 is positioned between the lower side tray 50 and the upper side tray 60 and the recording head 30 in the height direction of the apparatus, and the discharged-paper receiving tray 8 is in the storage position (FIG. 4), an upstream end section 8*h* thereof has a clearance L1 (FIG. 4) so that the upstream end section 8*h* does not block the paper feeding path. However, when the clearance L1 is further reduced and the upstream end section 8*h* of the discharged-paper receiving tray 8 is formed so as not to block the paper feeding path (in a state where the upstream end section 8*h* almost comes into contact with the separation slope 16), the discharged-paper receiving tray 8, that is, the paper receiving surface 8*a* can be secured larger and the paper is able to be received further reliably.

In addition, a reference numeral 34*a* in FIGS. 4 to 6 is a partition plate which is formed in the frame 34 and partitions between storage regions of lower side tray 50 and the upper side tray 60, and a storage region of the discharged-paper receiving tray 8. When the partition plate 34*a* is cancelled, the dimensions in the height direction of the apparatus can be further reduced.

Second Embodiment

Figure 10:
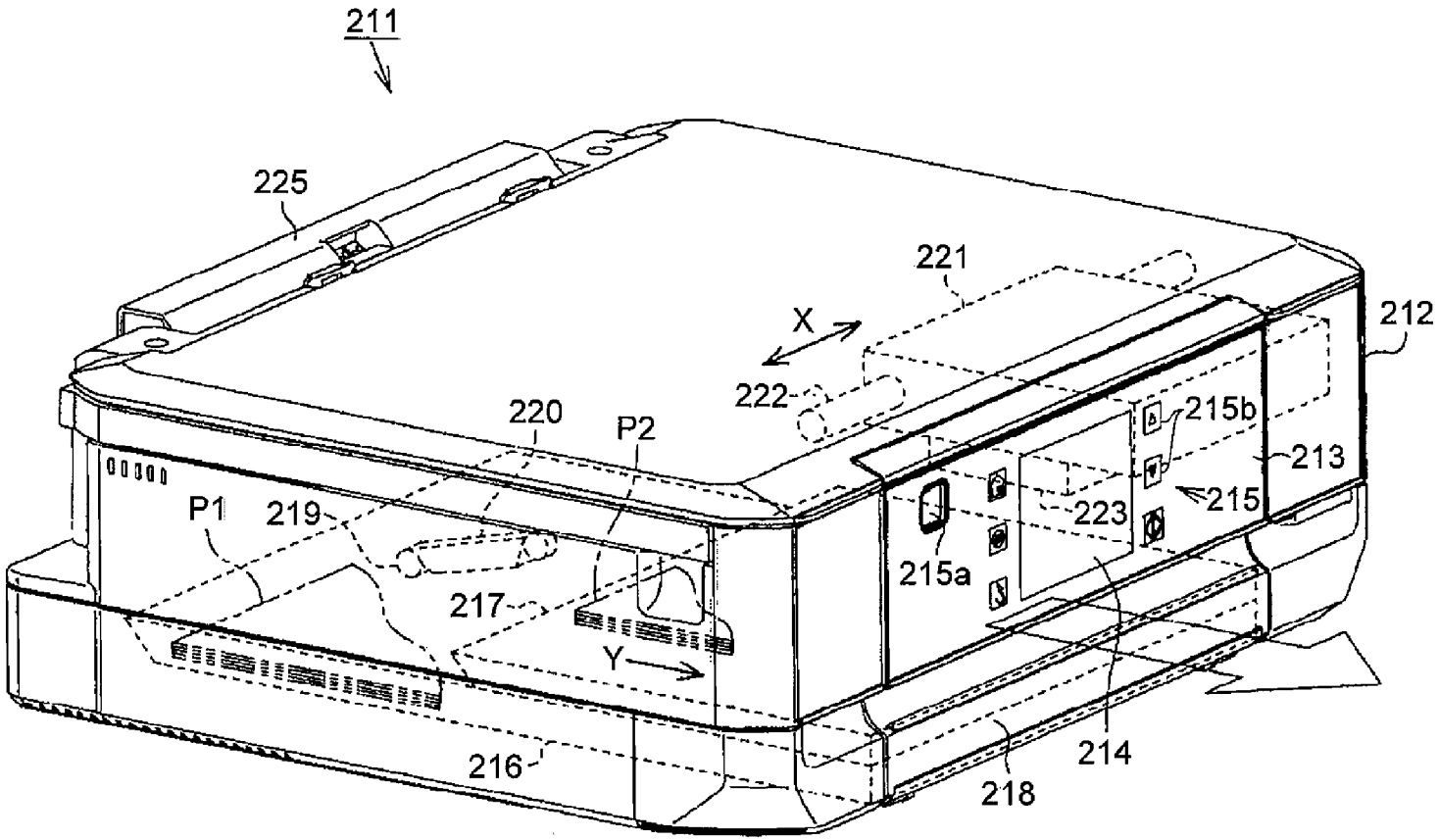
FIG. 10 is a perspective view of an ink jet type printer of a second embodiment.

In the second embodiment, a recording apparatus including a discharged-paper receiving tray in which a notch section having a width which is narrower towards downstream in the discharging direction is formed is described. As illustrated in FIG. 10, as an example of the recording apparatus, an ink jet type printer 211 includes an apparatus body 212 as an example of a case body having a substantially rectangular shape and an operation panel 213 which is provided in the front surface (right surface in FIG. 10) of the apparatus body 212 and is used for an input operation by a user. The operation panel 213 includes a display section 214 configured of a liquid crystal panel or the like and an operation section 215 configured of a plurality of operation switches.

The operation section 215 includes a power switch 215*a* for ON-OFF operation of the power supply of the ink jet type printer 211 and a selection switch 215*b* for selecting a desired selected article on a menu screen displayed in the display section 214. Two-stage feeding cassettes 216 and 217 which are arranged in the vertical direction are mounted on a lower position of the operation panel 213 in the front surface of the apparatus body 212. The feeding cassettes 216 and 217 are able to store a plurality of the papers P as an example of the recording media and are detachably (insertably) provided independently to each other.

A feeding cassette (below, also referred to as "a lower cassette 216") of two feeding cassettes 216 and 217, which is disposed in the lower side, includes a cover 218 capable of opening around the lower portion as a rotation shaft at the front surface side thereof (the right surface in FIG. 10). Each cover 218 is capable of being pulled out. Meanwhile, a feeding cassette (also referred to as "an upper cassette 217") of two feeding cassettes 216 and 217, which is disposed in the upper side, is detachably mounted on a mounting opening which is exposed by opening the cover 218, for example, in a state where the lower cassette 216 is mounted.

Then, in the embodiment, the lower cassette 216 stores the paper P1 having a relatively large size. The lower cassette 216 has a length which is shorter than the entire length (depth length) of the ink jet type printer 211 in the transportation direction Y and has a width which is wider than the maximum paper width n the width direction X.

Meanwhile, the upper cassette 217 stores the paper P2 having a relatively small size. The upper cassette 217 has a length which is shorter than the entire length of the lower cassette 216 in the transportation direction Y and has a width which is substantially the same as that of the lower cassette 216 in the width direction X. In the example, the length of the upper cassette 217 in the transportation direction Y is set to be about ⅔ of the length of the lower cassette 216 in the transportation direction Y.

The upper cassette 217 is a motor-driven type which is able to reciprocate in the transportation direction Y and is movable between an ejected position (a position illustrated in FIG. 13) of the cover 218 side which is able to be detached and mounted by a user and a feeding position (a position illustrated in FIG. 14) which is moved from the ejected position to the rear side (left side in FIG. 10) inside the apparatus body 212. Accordingly, the user is able to eject the upper cassette 217 when opening the cover 218 in a state where the upper cassette 217 is disposed in the ejected position.

On the other hand, for example, in a state where the upper cassette 217 is positioned in a feeding position which is positioned in the rear side inside the apparatus body 212, since the user cannot easily grasp the upper cassette 217, it is difficult to eject the upper cassette 217.

As illustrated in FIG. 10, a pick-up roller 219 is disposed in a position near the back of each of cassettes 216 and 217 in the center portion in the width direction X in a state where the pick-up roller 219 is rotatably supported to the front end of an oscillation member 220 as an example of another member inside the apparatus body 212. The pick-up roller 219 is provided only one commonly in the lower cassette 216 and the upper cassette 217.

Then, when the upper cassette 217 is in the ejected position, the front end of the oscillation member 220 is tilted to be lowered and then the pick-up roller 219 abuts the upper surface of the paper P1 stored in the lower cassette 216. In this state, the uppermost single sheet P1 is delivered from the lower cassette 216 to downstream in the feeding direction by the rotation of the pick-up roller 219.

In addition, when the upper cassette 217 is in the feeding position, the oscillation member 220 is pushed up by the upper cassette 217 and the pick-up roller 219 abuts the uppermost single sheet of the papers P2 stored inside the upper cassette 217. In this state, the uppermost single sheet P2 is delivered from the upper cassette 217 to downstream in the feeding direction by the rotation of the pick-up roller 219.

Then, the paper P fed from one of both cassettes 216 and 217 is transported along a predetermined feeding path in the transportation direction Y while being converted at the rear portion inside the apparatus body 212. In addition, in the specification, the paper stored in the lower cassette 216 is referred to as a reference numeral "P1" and the paper stored in the upper cassette 217 is referred to as a reference numeral "P2". In addition, if there is no particular need to distinguish the cassette in which the papers are stored, it is simply referred to as "paper P".

As illustrated in FIG. 10, a carriage 221 is reciprocally supported to a guide shaft 222 which is installed to extend in the main scanning direction X (the width direction in the example) orthogonal to the transportation direction Y inside the apparatus body 212. In other words, the carriage 221 is able to reciprocate along the main scanning direction X while being guided by the guide shaft 222.

A recording head 223 having a plurality of nozzles (not illustrated) for performing the printing (recording) by ejecting ink droplets on the paper P which is transported downstream along the feeding path is installed in the lower portion of the carriage 221. The ink is supplied to the recording head 223 from an ink cartridge (not illustrated) mounted on the carriage 221.

Then, the printed paper P on which the ink droplets are ejected by the recording head 223 is discharged from a discharge port, which is exposed in a state where the cover 218 is open, in a direction (the discharging direction) illustrated by a white arrow in FIG. 10. In other words, the printed paper P is discharged on a discharged paper tray 224 (see, FIG. 14) along an in-out direction (a right-left direction in FIGS. 13 and 14) of the discharged paper tray 224 with respect to the apparatus body 212 in a state where the discharged paper tray 224 is provided so as to be able to enter the apparatus body 212 and is protruded from the apparatus body 212 to the outside. The discharged paper tray 224 is an example of a discharge tray (a discharged-paper receiving tray).

In addition, an openable cover 225 closing an insertion opening, in which the paper P is able to be inserted manually, is provided in the rear portion of the apparatus body 212. The paper P is also able to be inserted from the insertion opening manually by opening the cover 225.

Figure 11:
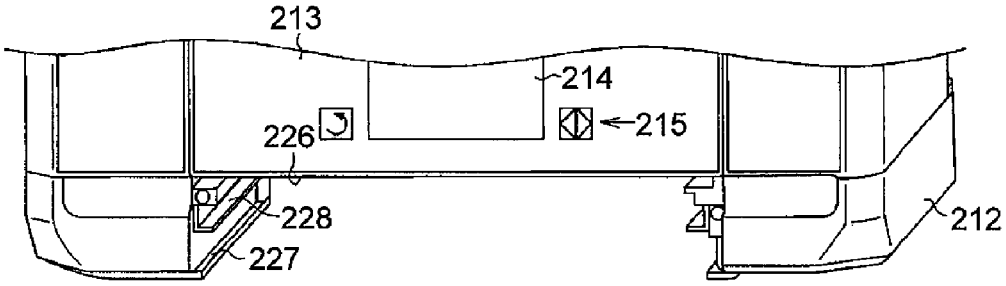
FIG. 11 is a partial perspective view illustrating a periphery of a receiving concave section in which a feeding cassette is detachable in the same printer.

As illustrated in FIG. 11, a cassette-storage recess section 226 for mounting the cassettes 216 and 217 is recessed in the lower side of the operation panel 213 in the apparatus body 212 so as to extend along a depth direction. A lower guide rail 227 and an upper guide rail 228 are provided in the right and left inner-wall sections of the cassette-storage recess section 226 in the apparatus body 212. The lower guide rail 227 guides the lower cassette 216 in the insertion-extraction direction and supports the lower cassette 216, and the upper guide rail 228 is positioned slightly above from the lower guide rail 227 and guides the upper cassette 217 in the insertion-extraction direction, and supports the upper cassette 217.

As described above, the lower cassette 216 is moved in the insertion-extraction direction and may be mounted and ejected from the cassette-storage recess section 226 by being guided on the lower guide rail 227. In addition, the upper cassette 217 is moved in the insertion-extraction direction and may be mounted and ejected from the cassette-storage recess section 226 by being guided on the upper guide rail 228.

However, when the upper cassette 217 is mounted, the upper cassette 217 is not reached to the feeding position but usually disposed in the ejected position. Then, the upper cassette 217 mounted in the ejected position moves between the ejected position and the feeding position along the upper guide rail 228 by a motor. In addition, a detailed configuration of the feeding mechanism including each of cassettes 216 and 217, the pick-up roller 219 or the like will be described below.

Next, the configuration of each of the cassettes 216 and 217 will be described.

Figure 12A:
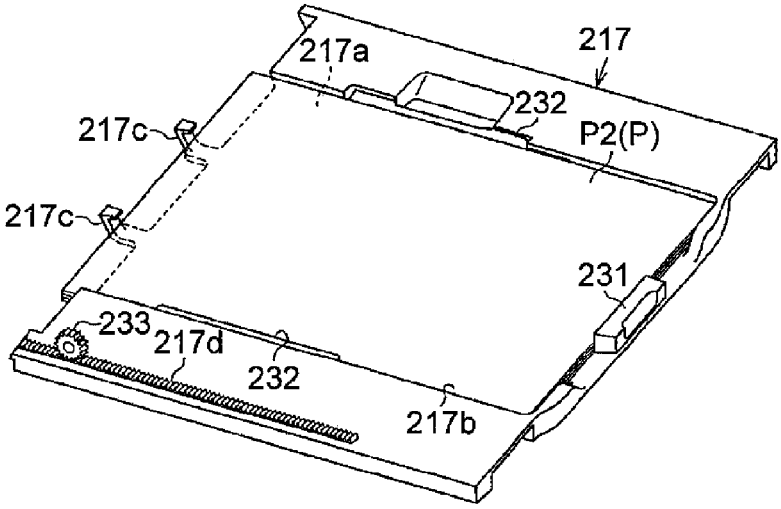
FIG. 12A is a perspective view illustrating an upper cassette and FIG. 12B is a perspective view illustrating a lower cassette.
Figure 12B:
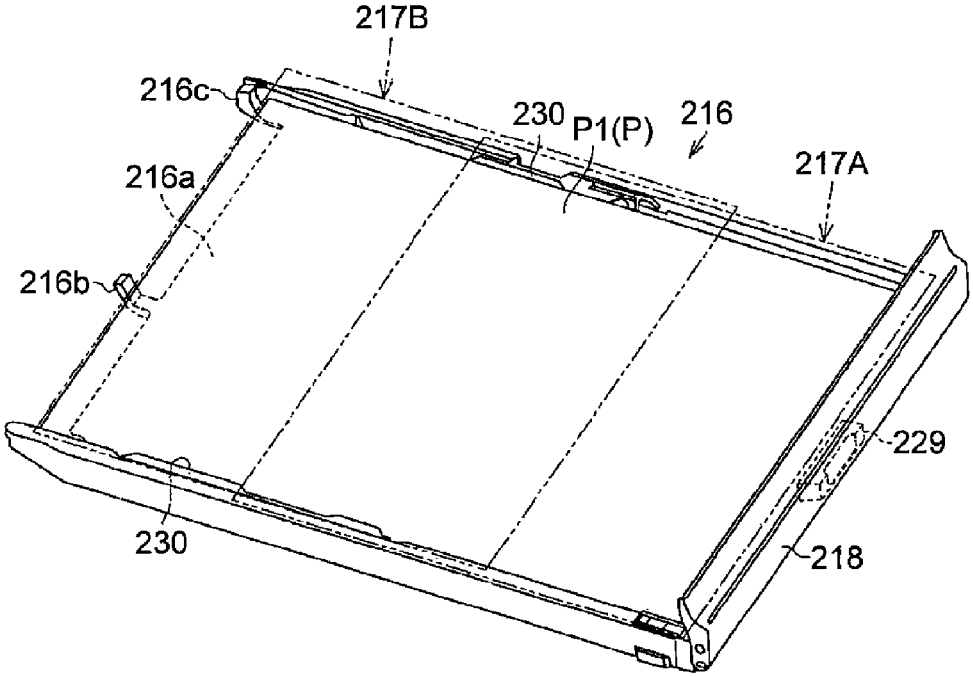

As illustrated in FIG. 12B, the lower cassette 216 has a bottom surface 216*a* capable of placing the paper P1 and an edge guide 229 capable of sliding in the paper delivering direction (opposite transportation direction Y) is provided in the position of the end portion of the bottom surface 216*a* in the cover 218 side. The position of a rear end edge of the paper P is regulated by the edge guide 229. In addition, the lower cassette 216 also has a pair of edge guides 230 capable of sliding in the paper width direction (the same as the width direction X in FIG. 10) orthogonal to the paper delivering direction.

The position of the side edges of the paper P1 is regulated by the pair of the edge guides 230. In the embodiment, the pair of the edge guides 230 is displaced in synchronization to be positioned symmetrically around the center position in the paper width direction. In other words, in the ink jet type printer 211 of the embodiment, the center position in the paper width direction is the feeding reference position.

In addition, a stopper 216*b* regulating the position of the paper front end is provided in the front end portion (the left end portion in FIG. 12B) of the lower cassette 216 in the mounting direction. The paper P1 set in the lower cassette 216 does not pop out from the lower cassette 216 by the stopper 216*b*.

Furthermore, a pressing section 216*c* is provided in the front end portion of the lower cassette 216. The pressing section 216*c* engages a holding mechanism (not illustrated) of the oscillation member 220 when the lower cassette 216 is mounted on the apparatus body 212 and the pick-up roller 219 is descended by releasing the holding of the oscillation member 220 and then the pick-up roller 219 abuts the paper P1 inside the lower cassette 216.

Meanwhile, as illustrated in FIG. 12A, the upper cassette 217 includes a storage recess section 217*b* having a bottom surface 217*a* capable of placing the paper P2. An edge guide 231 capable of sliding in the paper delivering direction is provided in the front end side (right end portion in FIG. 12A) in the bottom surface 217*a* in the mounting direction. In addition, a pair of edge guides 232 capable of sliding in the paper width direction is provided in the storage recess section 217*b* of the upper cassette 217.

The position of the side edges of the paper P2 is regulated by the pair of the edge guides 232. In the embodiment, the pair of the edge guides 232 is displaced in synchronization to be positioned symmetrically around the center position in the paper width direction.

In addition, a stopper 217*c* regulating the position of the paper front end is provided in the front end portion (the left end portion in FIG. 12A) of the upper cassette 217. The paper P2 set in the upper cassette 217 does not pop out from the upper cassette 217 by the stopper 217*c*. Furthermore, a pressing section 216*c* is provided in the front end portion of the lower cassette 216. The stopper 217*c* engages the oscillation member 220 while the upper cassette 217 moves from the ejected position to the feeding position and pushes the oscillation member 220 upwards, and in a state where the upper cassette 217 is disposed in the feeding position, the pick-up roller 219 abuts the paper P2 inside the upper cassette 217.

In addition, as illustrated in FIG. 12A, a rack section 217*d* having a predetermined length along the sliding direction (the paper delivering direction) of the upper cassette 217 is formed in the upper surface of one side end portion of the upper cassette 217 in the width direction. A rack and pinion mechanism is configured by mating the rack section 217*d* and the pinion 233.

The pinion 233 is rotated by a power of an electric motor and the mating position of the pinion 233 and the rack section 217*d* is changed by the rotation. In addition, the upper cassette 217 slides between the ejected position (the position illustrated in FIG. 13) of a two-dot chain line illustrated in reference numeral 217A in FIG. 12B and a feeding position (the position illustrated in FIG. 14) of a two-dot chain line illustrated in reference numeral 217B in the same drawing. In addition, in the embodiment, a power source of the upper cassette 217 is common with a power source of a transmission system transporting the paper P and uses a transportation motor (not illustrated).

Next, the configuration of the ink jet type printer 211 will be described.

Figure 13:
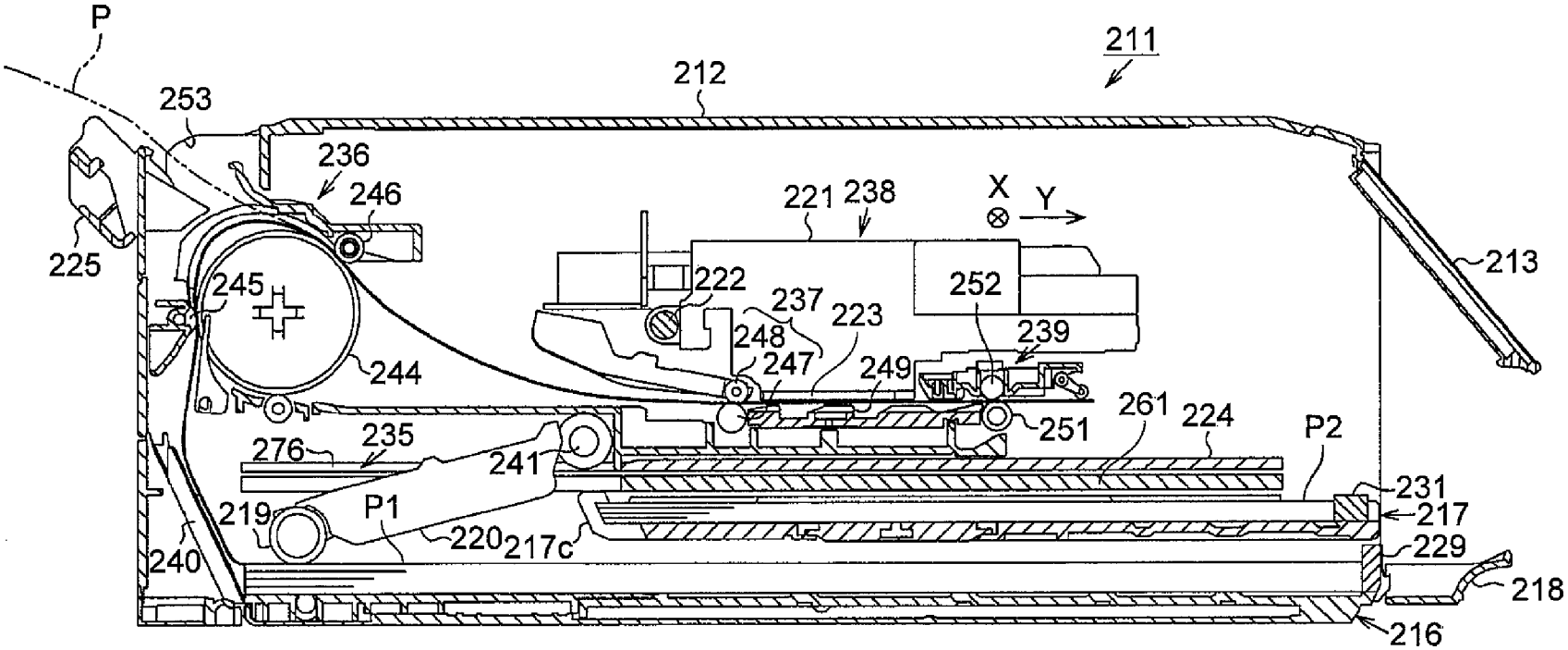
FIG. 13 is a schematic side cross-sectional view of an ink jet type printer when a discharged-paper receiving tray is in a storage position.
Figure 14:
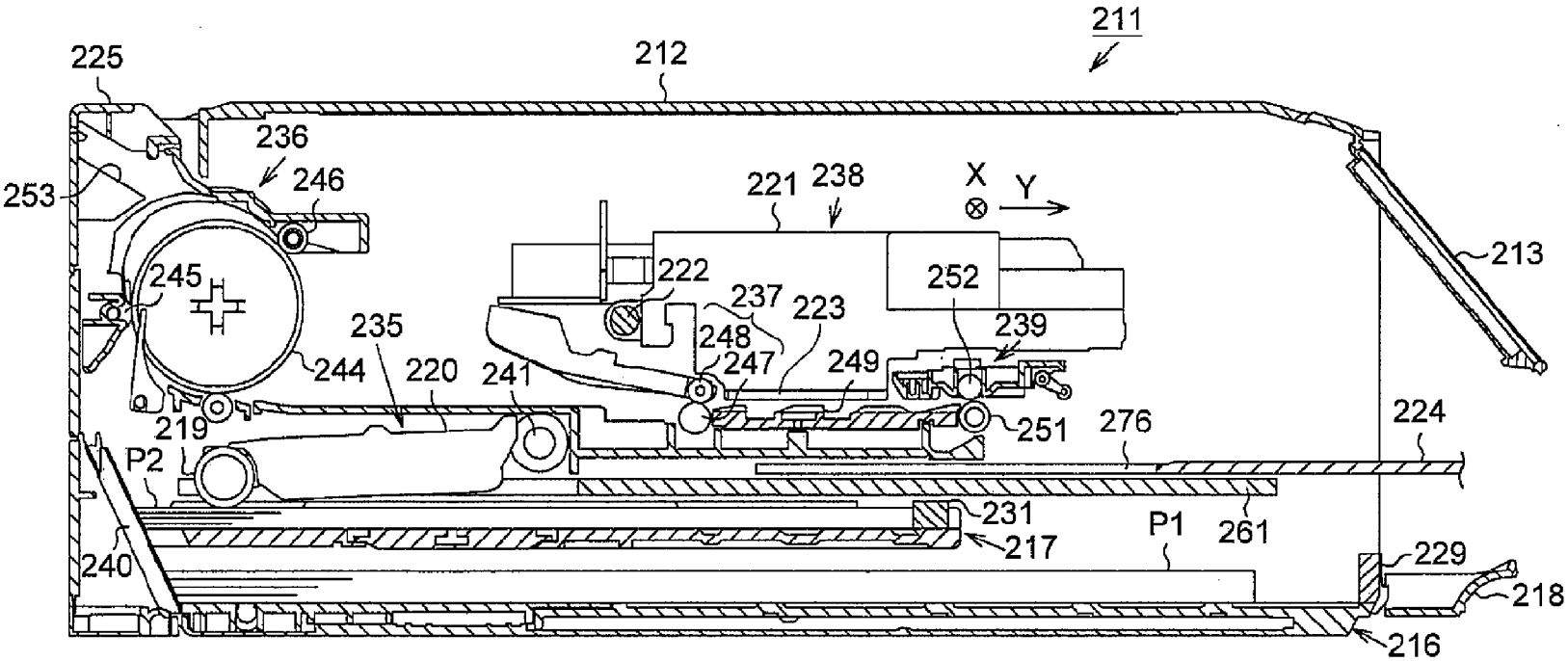
FIG. 14 is a schematic side cross-sectional view of an ink jet type printer when a discharged-paper receiving tray is in a use position.

As illustrated in FIGS. 13 and 14, the apparatus body 212 includes a cassette feeding section 235, a feeding section 236, a medium transportation section 237, a recording section 238 and a delivering section 239. The cassette feeding section 235 includes the lower cassette 216, the upper cassette 217, the pick-up roller 219 and a separation section 240 which is provided in a position facing the front end of the paper P stored in each of the cassettes 216 and 217.

The lower cassette 216 and the upper cassette 217 provided above thereof are able to store a plurality of the papers P1 and P2, respectively in a state of being laminated, and are able to mount on the apparatus body 212, independently. In addition, even though one of both cassettes 216 and 217 is not mounted, if the other cassette is mounted, the paper P is fed from the mounted cassette. The upper cassette 217 is displaced to be slidable between the ejected position (the position illustrated in FIG. 13) and the feeding position (the position illustrated in FIG. 14) by a power of a transportation motor (not illustrated).

As illustrated in FIGS. 13 and 14, the pick-up roller 219 is rotatably installed in the front end portion of the oscillation member 220 which is oscillatably supported around an oscillation shaft 241 in a support frame (not illustrated) inside the apparatus body 212. The pick-up roller 219 is driven to rotate by transmitting power from a transportation motor (not illustrated) via a gear train 260 (see, FIG. 15) inside the oscillation member 220.

The oscillation member 220 includes a holding member (not illustrated) which is provided in a position in which the pressing section 216*c* (FIG. 12B) of the lower cassette 216 is able to be engaged and is able to hold the pick-up roller 219 in the middle position, and a cam follower (not illustrated) which is provided in a position capable of engaging with a stopper 217*c* of the upper cassette 217.

In a state where each of the cassettes 216 and 217 is not mounted or in a state where the upper cassette 217 is in the ejected position, when the lower cassette 216 is inserted into the apparatus body 212, the pressing section 216*c* (see, FIG. 12B) formed in the front end portion of the lower cassette 216 engages to the holding mechanism (not illustrated) in the process that the lower cassette 216 moves to a butted position (the position illustrated in FIG. 13) in the moving direction. Then, the holding state of the pick-up roller 219 by the holding mechanism is released.

Accordingly, the pick-up roller 219 descends to a position in which the pick-up roller abuts the paper P1 stored in the lower cassette 216. Thus, when the upper cassette 217 is in the ejected position illustrated in FIG. 13, the pick-up roller 219 abuts the uppermost single sheet P1 inside the lower cassette 216 and when, in this state, the pick-up roller 219 is rotated by driving of the transportation motor (not illustrated), the uppermost paper P1 is delivered from the lower cassette 216 to downstream the feeding path.

In addition, in the process that the upper cassette 217 moves from the ejected position (the position illustrated FIG. 13) in which the pick-up roller 219 is inserted into the apparatus body 212 to the feeding position (the position illustrated in FIG. 14) which is the butted position in the moving direction, the stopper 217*c* of the front end portion of the upper cassette 217 engages to a cam follower (not illustrated) of the oscillation member 220 and the oscillation member 220 is pressed upwards. After that, when the engagement of the stopper 217*c* and the cam follower (not illustrated) is released, the pick-up roller 219 descends to the position (the position illustrated in FIG. 14) in which the pick-up roller 219 abuts the paper P2 stored in the upper cassette 217.

Thus, as illustrated in FIG. 14, when the upper cassette 217 is in the feeding position, the pick-up roller 219 abuts the uppermost paper P2 stored in the upper cassette 217 and, in this state, the pick-up roller 219 is rotated by the driving of the transportation motor (not illustrated) and then the uppermost paper P2 is delivered from the upper cassette 217 to downstream the feeding path.

In addition, even though one of the lower cassette 216 and the upper cassette 217 is not mounted, the paper P is able to be fed from the other cassette. In addition, the uppermost paper P delivered from one of the cassettes 216 and 217 by the rotation of the pick-up roller 219 separates from hereafter papers P by the separation section 240 in the delivery process.

As illustrated in FIGS. 13 and 14, the feeding section 236, which is provided downstream the separation section 240 in the feeding path, includes a feeding drive roller 244 driven by the transportation motor (not illustrated), a separation roller 245 and a feeding driven roller 246. The separation roller 245 comes into contact with the feeding drive roller 244 and performs the separation of the paper P again, and reliably delivers only the uppermost paper P downstream the feeding path.

In addition, the paper P sandwiched between the feeding drive roller 244 and the feeding driven roller 246 is transported to the medium transportation section 237. The medium transportation section 237 includes a transportation drive roller 247 which is driven by the same transportation motor (not illustrated) and a transportation driven roller 248 which is driven to be rotate by being pressed to the transportation drive roller 247. The paper P is further delivered downstream by the medium transportation section 237.

As illustrated in FIGS. 13 and 14, the recording section 238 provided downstream the medium transportation section 237 in the transportation direction Y includes the carriage 221, the recording head 223 and a support board 249 facing the recording head 223. In addition, the discharged paper tray 224 is disposed between the upper cassette 217 and the support board 249 disposed above more than the upper cassette 217 inside the apparatus body 212. Furthermore, a substantially rectangular plate-shaped support member 261 is fixed between the upper cassette 217 and the discharged paper tray 224 inside the apparatus body 212.

The support member 261 slidably supports the discharged paper tray 224 while guiding the discharged paper tray 224 along the transportation direction Y that is the paper discharging direction (the discharging direction) of the paper P. In other words, the discharged paper tray 224 is an electric motor type and is able to reciprocate between the storage position (the position illustrated in FIG. 13) stored inside the apparatus body 212 and the use position (the position illustrated in FIG. 14) protruding from the front side of the apparatus body 212 to the outside.

Then, the recording head 223 provided in a state of facing the paper P at the bottom portion of the carriage 221 ejects the ink droplets to the paper P and prints the image on the paper P in the process that the carriage 221 reciprocates in the main scanning direction X (the direction orthogonal to the paper surface in FIGS. 13 and 14) while being guided by the guide shaft 222 with the power of the carriage motor (not illustrated). At this time, the support board 249 supports the paper P and defines a distance (a gap) between the paper P and the recording head 223.

In addition, the delivering section 239 provided downstream the support board 249 includes a first roller 251 driven by the transportation motor (not illustrated) and a second roller 252 driven to rotate by coming into contact with the first roller 251. Then, the paper P which is printed (recorded) in the recording section 238 is discharged on the discharged paper tray 224 in the use position after delivered downstream in the transportation direction Y by the delivering section 239.

In addition, the discharged paper tray 224 is driven by a common power source with the operation panel 213 and the operation panel 213 rotates in a predetermined posture angle and then the moving path of the discharged paper tray 224 is open. Then, the discharged paper tray 224 is moved to slide from the apparatus body 212 to the use position that is a predetermined protrusion amount.

In addition, as illustrated in FIG. 13, a medium feeding section capable of feeding the paper manually is provided in the rear upper portion (the left upper portion in FIG. 13) of the apparatus body 212. The paper P can be inserted manually from a feeding opening 253 exposed when a manual cover 225 is open (illustrated in a two-dot chain line in FIG. 13).

The paper P inserted manually is inserted between the feeding drive roller 244 and the feeding driven roller 246 and, in this state, the paper P is transported downstream in the transportation direction Y by the medium transportation section 237 and the delivering section 239 by the driving of the transportation motor (not illustrated). In other words, the feeding of the paper P from each of the cassettes 216 and 217 and the feeding of the paper P manually have a common transportation path after a nip point between the feeding drive roller 244 and the feeding driven roller 246.

Next, a configuration of the discharged paper tray 224 will be described.

Figure 15:
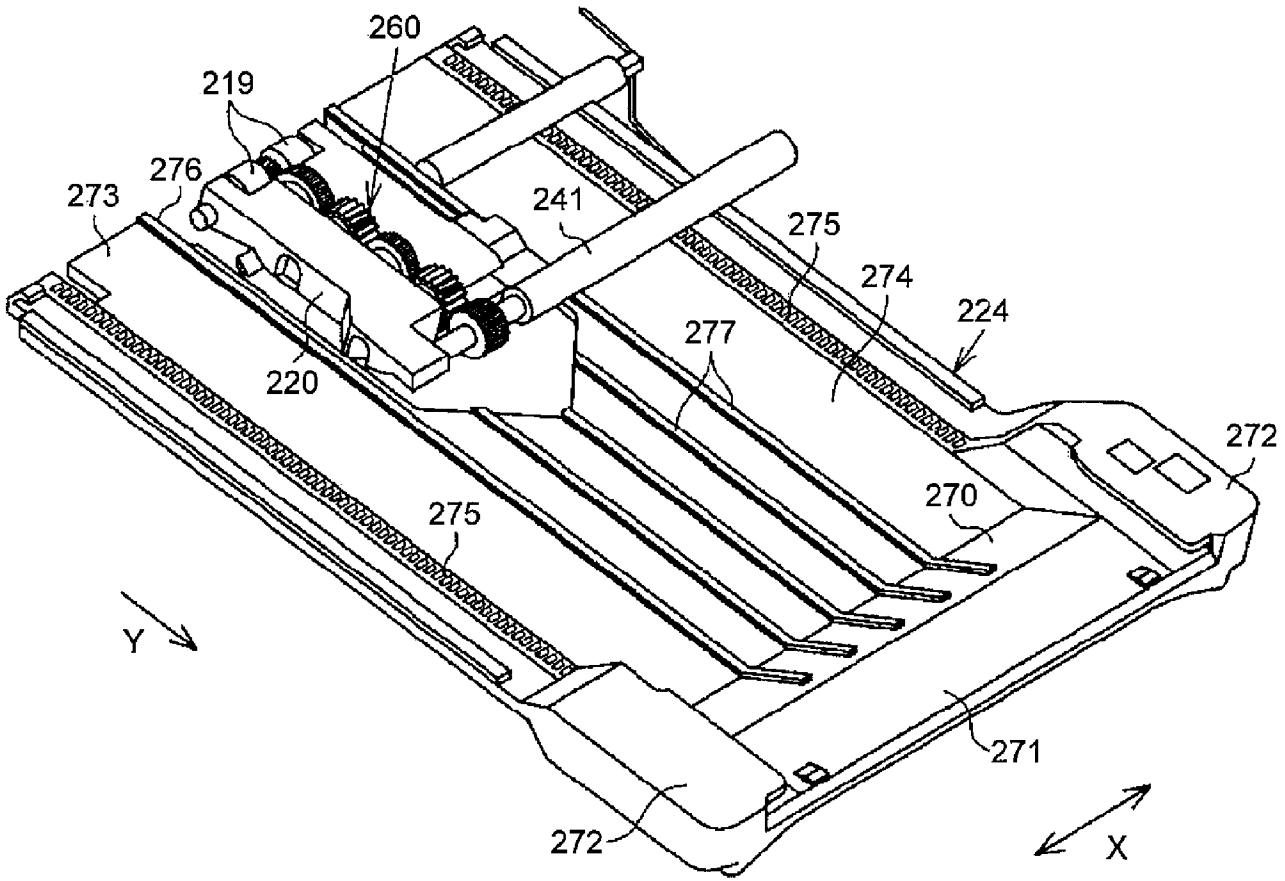
FIG. 15 is a perspective view illustrating a positional relationship between the discharged-paper receiving tray and an oscillation member when the discharged-paper receiving tray is in a storage position.

As illustrated in FIG. 15, the discharged paper tray 224 includes a board section 271 which is bulged upwards while forming an inclined guide surface 270 inclined so that the front end portion thereof rises towards the front end side in the transportation direction Y and a pair of ridge-shaped sections 272 which are adjacent to both sides of the board section 271 in the width direction (the same as the main scanning direction X) and are raised higher than the board section 271. In addition, the discharged paper tray 224 has a rectangular-shaped base section 273 that is a portion excluding the front end portion.

An upper surface of the base section 273 in the discharged paper tray 224 is a medium receiving surface 274. A pair of racks 275 extending along the transportation direction Y are provided in the both end portions in the paper width direction in the medium receiving surface 274. The pair of the racks 275 are engaged to a pair of pinions (not illustrated) rotated by a power of electric motor (not illustrated). Accordingly, the pair of the pinions (not illustrated) are rotated forwardly or reversely by the driving of the electric motor (not illustrated) so that the discharged paper tray 224 moves from the storage position (the position illustrated in FIG. 13) to the use position (the position illustrated in FIG. 14) or from the use position to the storage position.

In addition, a notch section 276 configuring a relief section is formed towards downstream in the transportation direction Y from the center portion in the width direction in the end portion of the base section 273 of the discharged paper tray 224 in the transportation direction Y in order to avoid contact with the oscillation member 220 supporting pick-up roller 219 when the discharged paper tray 224 moves to the storage position. Thus, the discharged paper tray 224 may be inserted into a deep position inside the apparatus body 212 in the storage position. Accordingly, the discharged paper tray 224 has one sheet (one stage) tray structure and can discharge the paper P having the maximum size which is printable in the recording section 238.

In addition, a plurality of (five in the example) ribs 277 extending along the transportation direction Y are protruded in the center portion on the medium receiving surface 274 of the discharged paper tray 224 in the width direction. Thus, the paper P discharged to the discharged paper tray 224 is placed on the medium receiving surface 274 while sliding on each of the ribs 277 so that sliding resistance between the paper P and the medium receiving surface 274 when the paper P is detected on the discharged paper tray 224 is small compared to a case where each of ribs 277 is not formed on the medium receiving surface 274.

Figure 16:
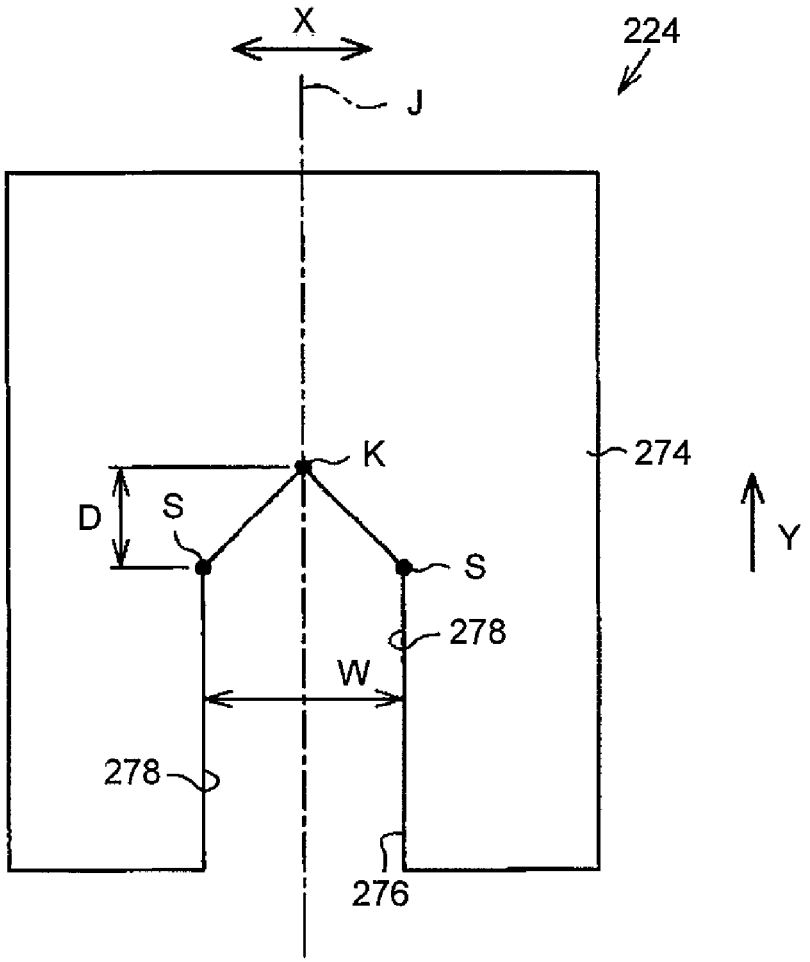
FIG. 16 is a schematic plan view of a discharged-paper receiving tray.

As illustrated in FIG. 16, the notch section 276 of the discharged paper tray 224 has a shape in which downstream ends S of both side sections 278 in the width direction X orthogonal to the transportation direction Y and a downstream end K in the transportation direction Y configured of one point are connected by a straight line, respectively. The both side sections 278 extend parallel to the transportation direction Y and have the same length as each other. The downstream end K of the notch section 276 is positioned at the center of the notch section 276 in the width direction X and is positioned downstream more than the downstream ends S of the both side sections 278 in the transportation direction Y.

Then, the shape which connects each of the downstream ends S of the both side sections 278 and the downstream end K with a straight line, respectively is an isosceles triangle. Accordingly, the width of the notch section 276 is gradually narrowed towards the downstream end K from the downstream ends S of the both side sections 278 of the notch section 276 to the downstream end K in the transportation direction Y.

In addition, a distance D from the downstream ends S of the both side sections 278 of the notch section 276 to the downstream end K in the transportation direction Y is set to be half of the width W (a distance between the both side sections 278) of the notch section 276. Furthermore, the width W of the notch section 276 is set to be wider than the width of the oscillation member 220 (see, FIG. 15) and narrower than the width of the paper P having the minimum width which is assumed of printing (recording) in the recording section 238.

Then, the notch section 276 has a line symmetrical shape with a symmetrical axis of a straight line J which passes through the downstream end K thereof and extends in the transportation direction Y. The straight line J bisects the discharged paper tray 224 in the width direction X. In addition, the length of the notch section 276 in the transportation direction Y is set to be slightly smaller than half of the length of the discharged paper tray 224.

Next, operation of the ink jet type printer 211 will be described.

When the paper P2 (P) inside the upper cassette 217 is printed, first, the upper cassette 217 which is in an ejected position is moved to be slidable to the feeding position. Then, as illustrated in FIG. 14, pick-up roller 219 abuts the uppermost one sheet of the papers P2 stored inside the upper cassette 217. In this state, when the pick-up roller 219 is rotated, the uppermost single sheet P2 is delivered from the upper cassette 217 downstream in the feeding direction.

The paper P2 delivered from the upper cassette 217 is transported along a predetermined transportation path in the transportation direction Y while being converted at the rear portion inside the apparatus body 212. Then, the paper P2 delivered in the transportation direction Y is printed in the recording section 238 and then is discharged on the discharged paper tray 224.

Figure 17A:
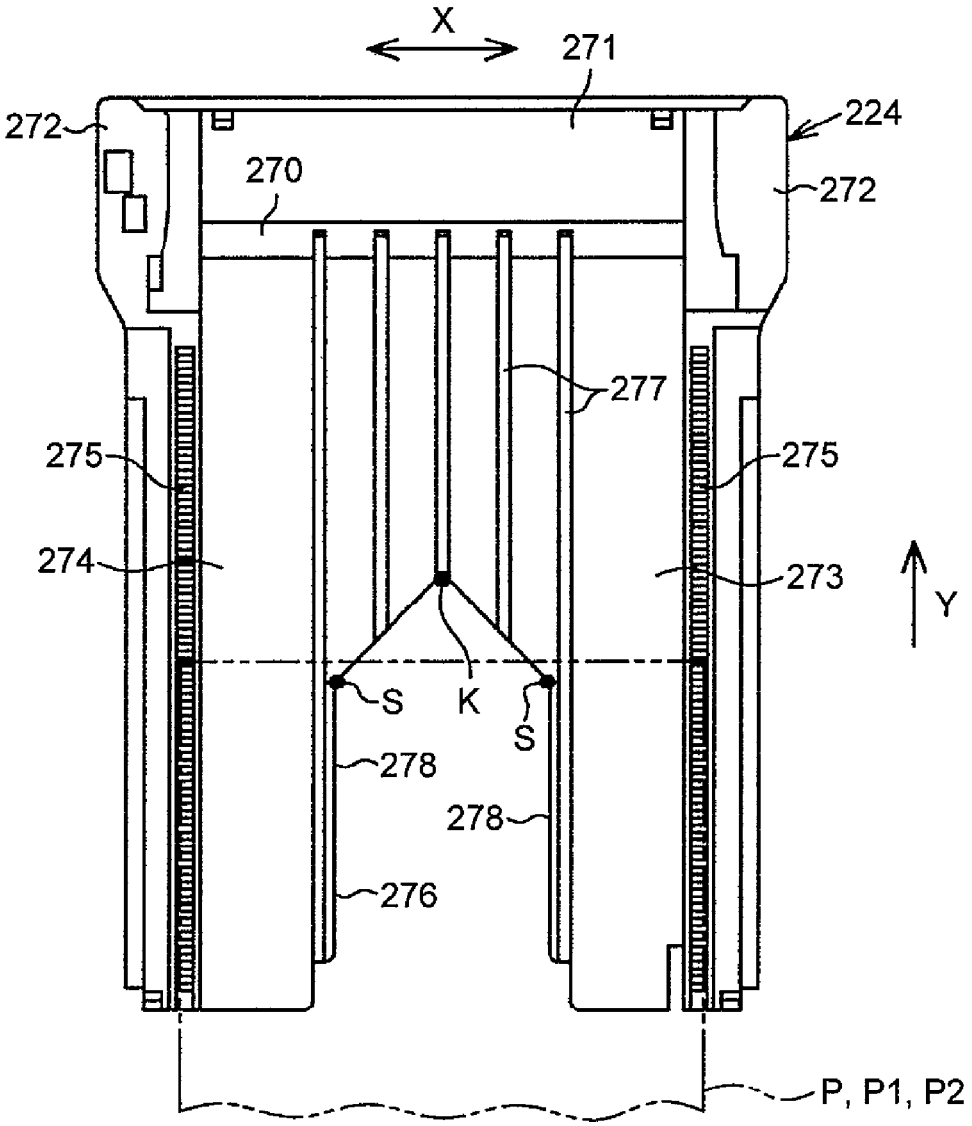
FIG. 17A is a plan view of a discharged-paper receiving tray and FIG. 17B is a front view of FIG. 17A.
Figure 17B:
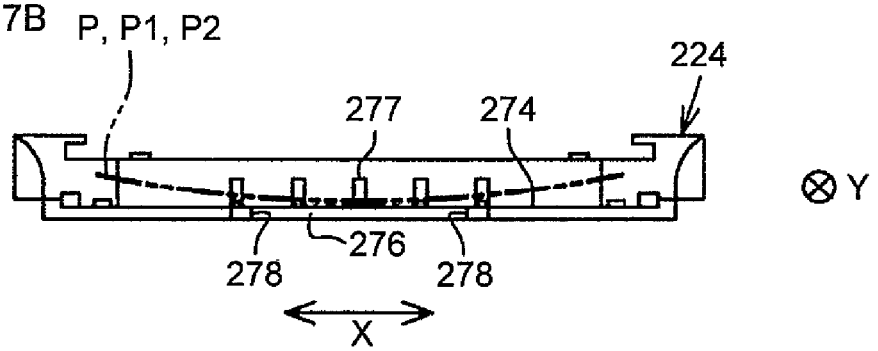

At this time, when the paper P2 discharged on the discharged paper tray 224 contains a lot of ink, cockling (waving) of the paper P2 is increased. In this state, when the paper P2 is discharged on the discharged paper tray 224, as illustrated in FIGS. 17A and 17B, the paper P2 slides towards downstream on the medium receiving surface 274 in a state where the paper P2 is slightly drooping in the center portion in the width direction X in the front end portion thereof in the transportation direction Y inside the notch section 276.

Then, when the front end portion of the paper P2 is beyond downstream the downstream ends S of the both side sections 278 of the notch section 276, the center portion of the front end portion of the paper P2 in the width direction X rises because the notch section 276 is gradually narrowed, in the process that the front end portion of the paper P2 slides on the notch section 276 from the downstream ends S of the both side sections 278 of the notch section 276 to the downstream end K of the notch section 276. In addition, the center portion of the paper P2 which is slightly drooped inside the notch section 276 in the width direction X in the front end portion rises.

Then, the center portion in the width direction X in the front end portion of the paper P2 which is slightly drooping inside the notch section 276 is led from the downstream end K of the notch section 276 on each of the ribs 277 downstream thereof. After that, the paper P2 slides towards downstream in the transportation direction Y on each of the ribs 277 and is placed on the discharged paper tray 224.

Meanwhile, when the paper P1 (P) inside the lower cassette 216 is printed, as illustrated in FIG. 13, pick-up roller 219 abuts the uppermost one sheet of the papers P1 stored inside the lower cassette 216, in a state where the upper cassette 217 is in an ejected position. In this state, when the pick-up roller 219 is rotated, the uppermost one sheet of the papers P1 is delivered from the lower cassette 216 towards downstream in the feeding direction. After that, the printing of the paper P2 is performed, and a similar advantage is obtained.

Figure 18A:
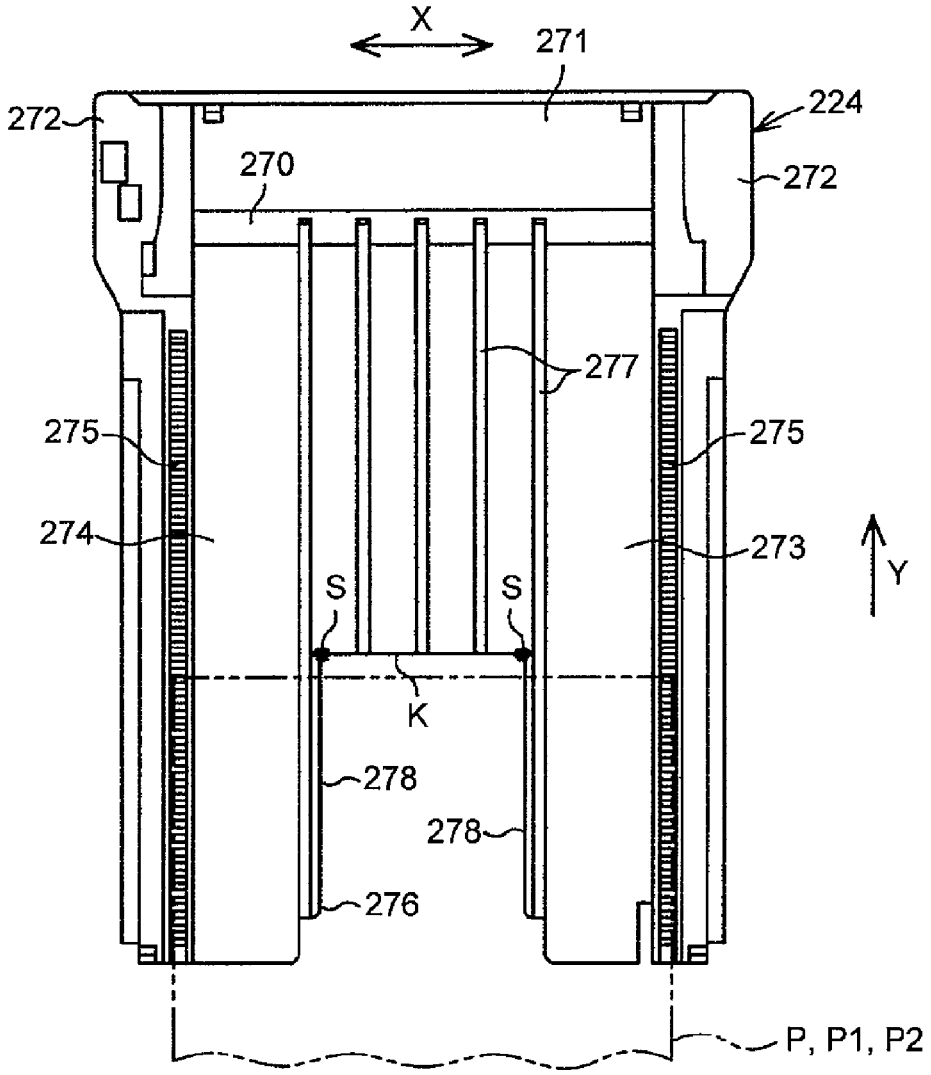
FIG. 18A is a plan view of a discharged-paper receiving tray of a comparative example and FIG. 18B is a front view of FIG. 18A.
Figure 18B:
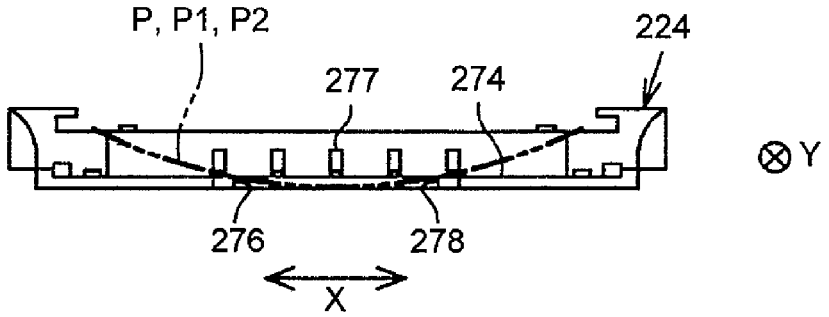

Incidentally, as illustrated in FIGS. 18A and 18B, as an comparison example of the embodiment, a shape is considered in which the downstream end K of the notch section 276 of the discharged paper tray 224 and the downstream ends S of the both side sections 278 are connected with a straight line in the width direction X. In this case, the front end portion of the drooping portion inside the notch section 276 in the paper P discharged on the discharged paper tray 224 is caught on the straight downstream end K extending in the width direction X of the notch section 276. Accordingly, there is a concern that the paper P may lead on each of ribs 277 downstream more than the notch section 276. Thus, there is a problem that a paper jam may occur and the paper P may not be smoothly discharged on the discharged paper tray 224.

In this regard, in the ink jet type printer 211 of the embodiment, as illustrated in FIG. 17A, the notch section 276 is provided in the discharged paper tray 224 and the notch section 276 is gradually narrowed towards downstream in the transportation direction Y from the downstream ends S of the both side sections 278 to the downstream end K configured of one point. Thus, as described above, the paper P discharged to discharged paper tray 224 is smoothly placed on the discharged paper tray 224 without being caught by the notch section 276.

According to the embodiment described above, advantages can be obtained as described below.

(1) The notch section 276 of the discharged paper tray 224 has a shape in which the downstream ends S of the both side sections 278 in the width direction X and the downstream end K of the notch section 276 configured of one point are connected, respectively. Thus, since the width of the notch section 276 is gradually narrowed towards downstream between the downstream ends S of the both side sections 278 and the downstream end K configured of one point in the discharging direction (the transportation direction Y), it is possible to suppress that the paper P discharged on the discharged paper tray 224 is caught on the downstream end K of the notch section 276. Accordingly, even though the notch section 276 is provided on the discharged paper tray 224 for discharging the paper P, the paper P can be smoothly discharged and placed on the discharged paper tray 224.

(2) The downstream end K of the notch section 276 of the discharged paper tray 224 is positioned at the center in the width direction X, Thus, it is possible to suppress that the paper P discharged on the discharged paper tray 224 is caught on the downstream end K of the notch section 276.

(3) The notch section 276 of the discharged paper tray 224 has the line symmetrical shape with a symmetrical axis of the straight line J which passes through the downstream end K thereof and extends along the discharging direction (the transportation direction Y). Thus, it is possible to suppress in good balance that the paper P discharged on the discharged paper tray 224 is caught on the downstream end K of the notch section 276.

(4) The width of the notch section 276 of the discharged paper tray 224 is set to be narrower than the width of the paper P having the minimum width which is assumed of printed in the recording section 238. Thus, it is possible to suppress that the paper P discharged on the discharged paper tray 224 falls from the notch section 276.

(5) The distance D from the downstream ends S of the both side sections 278 of the notch section 276 of the discharged paper tray 224 to the downstream end K of the notch section 276 in the discharging direction (the transportation direction Y) is the half of the width W of the notch section 276. Thus, it is possible to effectively suppress that the paper P discharged on the discharged paper tray 224 is caught on the downstream end K of the notch section 276 while suppressing the length of the notch section 276 in the discharging direction (the transportation direction Y).

MODIFICATION EXAMPLE

In addition, the above embodiment may be modified as described below.

Figure 19:
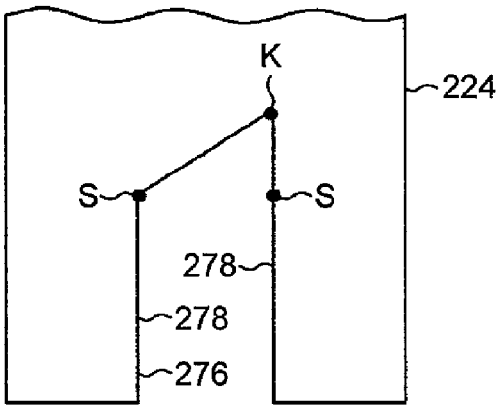
FIG. 19 is a partial schematic plan view illustrating a shape of a notch section of a discharged-paper receiving tray in a modification example.

As illustrated in FIG. 19, in the notch section 276 of the discharged paper tray 224, the downstream end K is not necessarily disposed at the center in the width direction X in the notch section 276. In other words, the downstream end K of the notch section 276 may be disposed at the end portion in the width direction X in the notch section 276.

Figure 20:
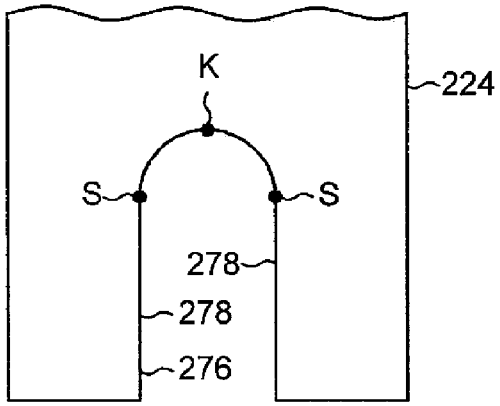
FIG. 20 is a partial schematic plan view illustrating a shape of a notch section of a discharged-paper receiving tray in a modification example.

As illustrated in FIG. 20, the notch section 276 of the discharged paper tray 224 may be a shape in which the downstream ends S of the both side sections 278 and the downstream end K configured of one point are connected to each other in circular arches which are bulged outwards, respectively. Otherwise, the notch section 276 of the discharged paper tray 224 may be a shape in which the downstream ends S of the both side sections 278 and the downstream end K configured of one point are connected to each other in circular arches which are bulged inwards, respectively.

Figure 21:
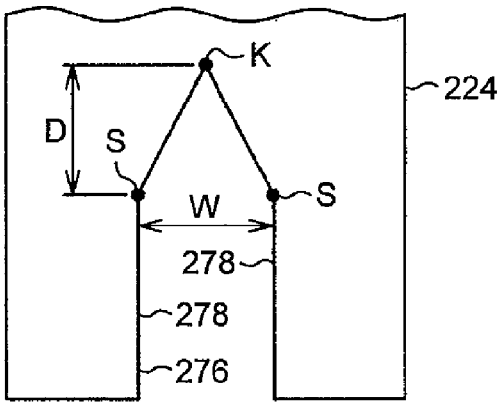
FIG. 21 is a partial schematic plan view illustrating a shape of a notch section of a discharged-paper receiving tray in a modification example.

As illustrated in FIG. 21, the distance D from the downstream ends S of the both side sections 278 of the notch section 276 to the downstream end K in the transportation direction Y may be greater than the half of the width W (the distance of the both side sections 278) of the notch section 276.

The notch section 276 of the discharged paper tray 224 does not necessarily have the line symmetrical shape with a symmetrical axis of the straight line J which passes through the downstream end K thereof and extends along the discharging direction (the transportation direction Y).

The downstream end K of the notch section 276 is not necessarily configured of one point. For example, if the downstream end K of the notch section 276 is shorter than the distance of the both side sections 278 in the width direction X, it may be configured of a straight line extending in the width direction X.

The ink jet type printer 211 may be a line printer such as a full-line head printer of which the entire shape corresponds to the entire width of the paper P in the width direction X other than the serial printer as described in the above embodiment.

The ink jet type printer 211 may be a so-called on-carrier type in which the ink cartridge is mounted on the carriage 221 as the above embodiment, and may be a so-called off-carry type in which the ink cartridge is mounted on a predetermined location other than the carriage 221 inside the apparatus body 212.

The recording apparatus may be a laser printer, a drum type print, a tandem type or the like printer, a thermal transfer type printer (including a dye sublimation printer) or a non-impact printer, and may be an impact printer such as a dot impact printer, other than the ink jet type printer 211.

In the embodiments described above, the recording apparatus may be a fluid ejecting apparatus ejecting or discharging fluids (including liquid or a liquid material consisting of particles of a functional material is dispersed or mixed in a liquid, a fluid material such as gel, a solid that may be ejected by flowing as the liquid), other than ink. For example, a liquid crystal display, an electroluminescence (EL) display, a liquid ejecting apparatus performing the recording by ejecting a liquid material including a material such as an electrode or color material (pixel material) used to produce a surface emitting display in a dispersed or dissolved form. In addition, the liquid ejecting apparatus may be a fluid material ejecting apparatus ejecting fluid material such as gel (for example, physical gel), a powder material ejecting apparatus (for example, a toner jet type recording apparatus) ejecting solid an example of which is powder (powder material) such as toner. Then, the invention may be applied to any one of those fluid material ejecting apparatuses. In addition, as the fluid, for example, liquid (including, for example, inorganic solvent, organic solvent, solution, liquid material resin, liquid material metal (liquid metal), or the like), liquid material, fluid material, powder material (including granules, powder or the like) or the like is included.

The entire disclosure of Japanese Patent Application No. 2012-041932, filed Feb. 28, 2012 and No. 2012-152161, filed Jul. 6, 2012 are expressly incorporated by reference herein.

What is claimed is:

1. A recording apparatus comprising:

a body;

a medium storage section storing a medium that is stored inside the body;

a feeding unit which delivers the medium from the medium storage section and has an oscillation member oscillating around a rotation shaft and a feeding roller which is rotatably installed in a front end portion of the oscillation member;

a recording unit which performs recording on the medium delivered from the medium storage section;

a discharging unit which discharges a recorded medium on which the recording is performed by the recording unit; and a medium receiving tray which receives the medium discharged by the discharging unit, and is separate from the medium storage section such that the medium receiving tray is configured to be movable independently of the medium storage section, wherein the medium receiving tray is positioned above the medium storage section, wherein the medium receiving tray is displaced between the storage position and a protrusion position in which the medium receiving tray is protruded from the body of the recording apparatus and receives the medium, by sliding in a medium discharging direction, wherein the medium receiving tray has a notch section that is provided at an upstream end of the medium receiving tray, wherein the rotation shaft of the feeding unit is positioned higher than the medium receiving tray, and wherein the notch section can be overlapped with a portion of the feeding unit in the movable direction when the medium receiving tray is stored inside the body.

2. The recording apparatus according to claim 1, wherein the feeding unit including:

the feeding roller which is provided to be displaceable in an advancing and retracting direction with respect to a bottom surface of the medium storage section; and a roller support member which supports the feeding roller and is provided to be oscillated so that the feeding roller is capable of being displaced; and wherein the roller support member is positioned inside the notch section when the medium receiving tray is positioned in the storage position.

3. The recording apparatus according to claim 1, wherein the medium receiving tray is configured such that an entire region of a medium receiving surface which receives the medium is formed of one member and the notch section is formed in one member.

4. The recording apparatus according to claim 1, wherein the medium receiving tray includes a ridge section on which both end portions of the medium ride downstream the medium receiving surface which receives the medium in a direction intersecting the medium discharging direction, and wherein the notch section is provided at the center portion upstream the medium receiving surface in a direction intersecting the medium discharging direction.

5. The recording apparatus according to claim 1, wherein a rack section configuring a rack and pinion mechanism is formed along the medium discharging direction in the end portion of the medium receiving tray in a direction intersecting the medium discharging direction, and wherein the rack section has a configuration in which the medium receiving tray is operated to be slidable by receiving power.

6. The recording apparatus according to claim 1, wherein the medium receiving tray is positioned between the medium storage section and the recording unit in a height direction of the apparatus, and wherein the upstream end portion of the medium receiving tray is in a position in which the feeding path of the medium which is delivered from the medium storage section and directed towards the recording unit is closed when the medium receiving tray is in the storage position.

7. The recording apparatus according to claim 1, wherein the notch section is formed such that a width thereof is gradually narrowed from the both side sections of the width direction orthogonal to the medium discharging direction towards downstream in the medium discharging direction.

8. The recording apparatus according to claim 7, wherein the notch section has a shape in which the both end portions in the width direction orthogonal to the medium discharging direction and a downstream end in the medium discharging direction configured of one point are connected to each other.

9. The recording apparatus according to claim 8, wherein the downstream end of the notch section is positioned at the center in the width direction.

10. The recording apparatus according to claim 9, wherein the notch section has a line symmetrical shape with a symmetrical axis of the straight line which passes through the downstream end thereof and extends along the medium discharging direction.

11. The recording apparatus according to claim 7, wherein the width of the notch section is set to be narrower than the width of the recording medium having the minimum width which is assumed of recording in the recording unit.

12. The recording apparatus according to claim 8, wherein a distance from the both side portions of the notch section to the downstream end in the medium discharging direction is set to be equal to or greater than half of the width of the notch section.

13. A recording apparatus comprising:

a body;

a medium storage section storing a medium that is stored inside the body;

a feeding unit which delivers the medium from the medium storage section, and has an oscillation member oscillating around a rotation shaft and a feeding roller which is rotatably installed in a front end portion of the oscillation member;

a recording unit which performs recording on the medium delivered from the medium storage section;

a discharging unit which discharges a recorded medium on which the recording is performed by the recording unit; and a medium receiving tray which receives the medium discharged by the discharging unit, and is separate from the medium storage section such that the medium receiving tray is configured to be movable independently of the medium storage section, wherein the medium receiving tray is positioned above the medium storage section, wherein the medium receiving tray is displaced between the storage position and a protrusion position in which the medium receiving tray is protruded from the body of the recording apparatus and receives the medium, by sliding in a medium discharging direction, wherein the medium receiving tray has a notch section is provided at an upstream end of the medium receiving tray, wherein a part of the feeding unit is positioned higher than the medium receiving tray, and wherein the notch section can be overlapped with a portion of the feeding unit in the movable direction when the medium receiving tray is stored inside the body.

* * * * *